US007544152B2

(12) United States Patent
Dey et al.

(10) Patent No.: US 7,544,152 B2
(45) Date of Patent: Jun. 9, 2009

(54) LINKAGE BASED EXERCISE MACHINE

(75) Inventors: James Dey, Corona, CA (US); Victor Torres Cornejo, Tustin, CA (US); Mark William Chiles, Yorba Linda, CA (US); Felipe J. Marin, Santa Ana, CA (US); Kevin Patrick Corbalis, Tustin, CA (US)

(73) Assignee: Unisen, Inc., Irvine, CA (US)

( * ) Notice: Subject to any disclaimer, the term of this patent is extended or adjusted under 35 U.S.C. 154(b) by 419 days.

(21) Appl. No.: 11/392,371

(22) Filed: Mar. 29, 2006

(65) Prior Publication Data

US 2006/0172865 A1 Aug. 3, 2006

Related U.S. Application Data

(63) Continuation-in-part of application No. 11/192,977, filed on Jul. 29, 2005.

(60) Provisional application No. 60/732,873, filed on Nov. 2, 2005, provisional application No. 60/592,615, filed on Jul. 30, 2004.

(51) Int. Cl.
*A63B 22/04* (2006.01)
*A63B 22/06* (2006.01)

(52) U.S. Cl. ..... 482/52; 482/51; 482/57

(58) Field of Classification Search ..... 482/51–53, 482/57, 70, 79–80

See application file for complete search history.

(56) References Cited

U.S. PATENT DOCUMENTS 5,374,227 A 12/1994 Webb
5,637,058 A 6/1997 Rodgers, Jr.
5,690,589 A 11/1997 Rodgers, Jr.
5,738,614 A 4/1998 Rodgers, Jr.
5,766,113 A * 6/1998 Rodgers, Jr. ..... 482/52
5,769,760 A 6/1998 Lin et al.
5,788,610 A 8/1998 Eschenbach
5,792,026 A * 8/1998 Maresh et al. ..... 482/51
5,848,954 A 12/1998 Stearns et al.
5,899,833 A 5/1999 Ryan et al.
5,913,751 A 6/1999 Eschenbach
5,924,962 A 7/1999 Rodgers, Jr.
5,997,445 A 12/1999 Maresh et al.
6,045,487 A * 4/2000 Miller ..... 482/52
6,063,008 A 5/2000 McBride et al.
6,196,948 B1 3/2001 Stearns et al.
6,206,804 B1 3/2001 Maresh
6,277,055 B1 8/2001 Birrell et al.
6,500,096 B1 12/2002 Farney
6,544,146 B1 4/2003 Stearns et al.
6,645,125 B1 11/2003 Stearns et al.
6,672,994 B1 1/2004 Stearns et al.
6,837,829 B2 1/2005 Eschenbach (Continued)

OTHER PUBLICATIONS

International Search Report, 3 pages.

*Primary Examiner*—Steve R Crow
(74) *Attorney, Agent, or Firm*—Knobbe, Martens, Olson & Bear, LLP

(57) ABSTRACT

An exercise machine has a frame and an operating linkage. The operating linkage includes any of a number of mechanisms that can adjust a foot trace generated by the linkage. In one configuration, the foot trace can be adjusted between at least a generally vertical trace and a generally horizontal trace.

20 Claims, 24 Drawing Sheets

U.S. PATENT DOCUMENTS

| | | | |
|---|---|---|---|
| 7,223,209 | B2 | 5/2007 | Lee |
| 7,238,146 | B1 | 7/2007 | Chen |
| 2001/0056010 | A1 | 12/2001 | Stearns et al. |
| 2004/0053748 | A1 | 3/2004 | Lo et al. |
| 2004/0097339 | A1 | 5/2004 | Moon |
| 2004/0235621 | A1 | 11/2004 | Eschenbach |
| 2004/0248704 | A1 | 12/2004 | Rodgers, Jr. |
| 2004/0248705 | A1 | 12/2004 | Rodgers, Jr. |
| 2004/0248706 | A1 | 12/2004 | Rodgers, Jr. |
| 2004/0248707 | A1 | 12/2004 | Rodgers, Jr. |
| 2004/0248708 | A1 | 12/2004 | Rodgers, Jr. |
| 2004/0248709 | A1 | 12/2004 | Rodgers, Jr. |
| 2004/0248710 | A1 | 12/2004 | Rodgers, Jr. |
| 2004/0248711 | A1 | 12/2004 | Rodgers, Jr. |
| 2005/0003932 | A1 | 1/2005 | Chen et al. |
| 2006/0166791 | A1 | 7/2006 | Liao et al. |

* cited by examiner

LINKAGE BASED EXERCISE MACHINE

RELATED APPLICATIONS

This application is a continuation-in-part to U.S. patent application Ser. No. 11/192,977, filed Jul. 29, 2005, which claims the priority benefit of U.S. Provisional Patent Application No. 60/592,615, filed Jul. 30, 2004 and U.S. Provisional Patent Application No. 60/732,873, filed Nov. 2, 2005, each of which is hereby incorporated by reference in its entirety.

BACKGROUND OF THE INVENTION

1. Field of the Invention

The present invention generally relates to elliptical exercise machines. More particularly, the present invention relates to elliptical exercise machines featuring articulating linkages that generate foot traces for a user and that can be adjusted to vary the foot traces from generally horizontal to generally vertical.

2. Description of the Related Art

Most previous elliptical exercise machines have employed guides or tracks that forced one end of a foot support to move in a substantially linear manner while the other end of the foot support rotated about a crank axis. A user's foot would be positioned at an intermediate location along the foot support. As a result of this construction, the movement of the user's foot would generate a generally elliptical trace. Moreover, as a result of this construction, the user's foot would generate a generally horizontal foot trace.

Many exercise enthusiasts vary their workouts by switching the motions used during cardiovascular training. For instance, on one day, the workout features cardiovascular exercise on an elliptical machine and, on the next day, the workout features cardiovascular exercise on a stair climbing machine. Similarly, some individuals use both a stair climbing machine and an elliptical machine on the same visit to the gym so that they target different muscles while obtaining a sufficient cardiovascular workout.

In order to accommodate such diversity in workouts, gyms must maintain a wide array of machines. Many gyms, whether commercial or home, feature elliptical machines, stair climbing machines (e.g., stepper machines), treadmills and skier machines. Obtaining and maintaining such a diverse array of machines increases the operating costs of the gym.

SUMMARY OF THE INVENTION

Accordingly, an elliptical exercise machine has been developed that can provide varying foot traces. In accordance with one embodiment of the machine, the foot traces can be varied between a generally vertical foot trace and a generally horizontal foot trace.

In accordance with one embodiment of the machine, a linkage assembly that constrains a pair of foot pedals for elliptical movement is positioned entirely ahead of a rearmost portion of the foot pedals. In other words, the foot pedals or foot supports are cantilevered to a location rearward of the linkage assembly. At least a portion of the linkage assembly is adjustable to vary the foot trace from a first generally horizontal orientation to a second generally vertical orientation.

One aspect of the present invention involves an exercise machine that comprises a generally stationary frame assembly. An operating linkage is supported by the frame assembly. The operating linkage is connected to a foot support. The foot support is adapted to receive a user's foot. The operating linkage comprises a first crank and a second crank. The first crank is rotatable about a first axis and the second crank is rotatable about a second axis. A bell crank assembly comprises bell crank that is rotatable with the first crank and a lever arm that is connected to the bell crank such that rotation of the bell crank causes oscillation of the lever arm. The lever arm is connected to the foot support. A first connecting beam is connected to the first crank and a second connecting beam is connected to the second crank. The first and second connecting beams also are connected to the foot support such that the first and second connecting beams generate a generally circular movement at the foot support and such that the lever arm generates a generally linear movement at the foot support.

Another aspect of the present invention involves an exercise machine that comprises a generally stationary frame assembly. An operating linkage is supported by the frame assembly. The operating linkage comprises a first crank. The first crank has a first end that is connected to a first pivot axis and a second end that is connected to a first end of a first connecting beam. The operating linkage also comprises a second crank. The second crank has a first end that is connected to a second pivot axis and a second end that is connected to a first end of a second connecting beam. A foot beam is connected to a second end of the first connecting beam and a second end of the second connecting beam. A first end of a bell crank is rotatable with the first crank. A foot pad is supported by the foot beam. A second end of the bell crank is connected to a first end of a connecting rod. A second end of the connecting rod is connected to a first end of a lever arm. A lever arm pivot is positioned between the first end of the lever arm and a second end of the lever arm. The second end of the lever arm is connected to at least one component selected from the group consisting of the first connecting beam, the second connecting beam, and the foot beam.

BRIEF DESCRIPTION OF THE DRAWINGS

These features, aspects and advantages will be described in detail with reference to the accompanying drawings. The drawings comprise twenty-six figures.

DETAILED DESCRIPTION OF THE PREFERRED EMBODIMENT

Figure 1:
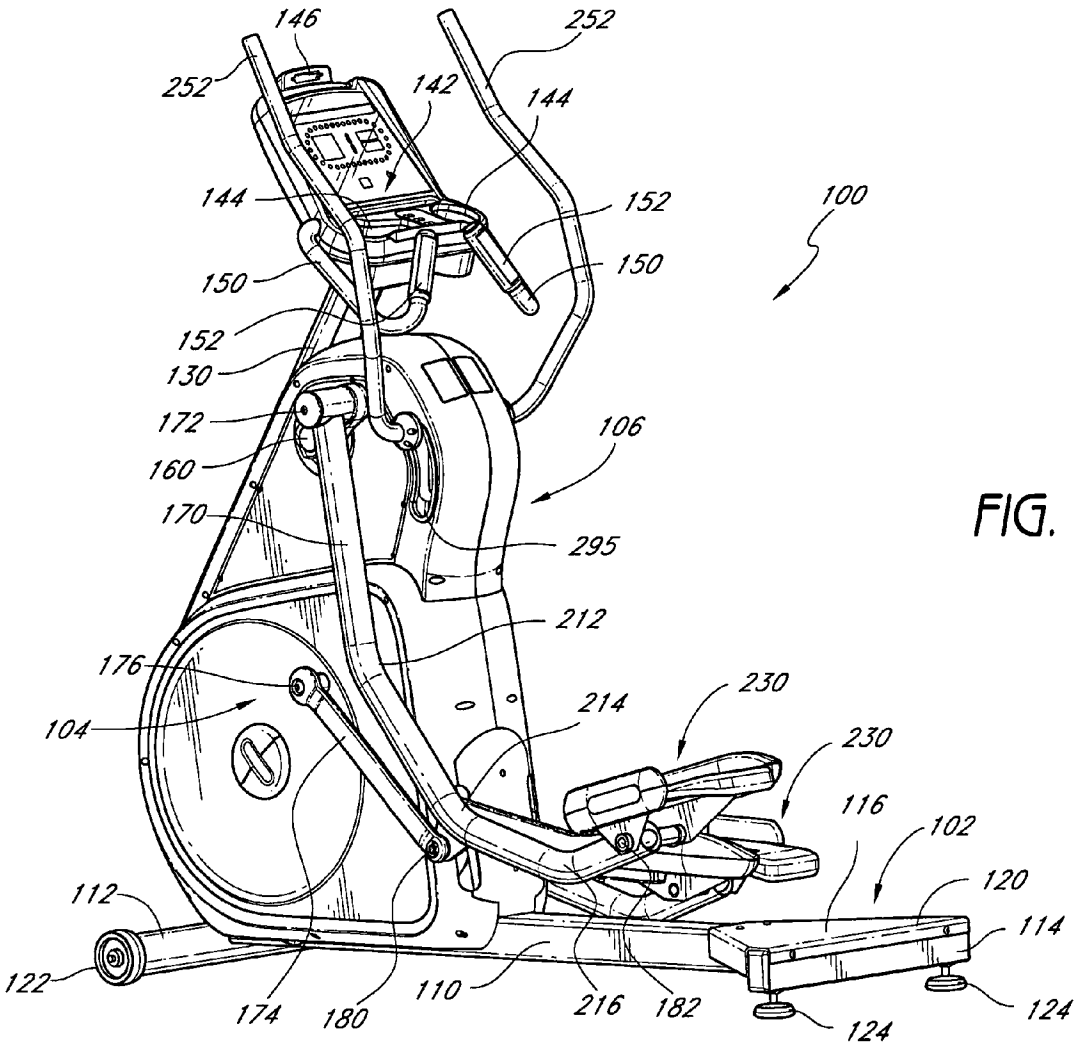
FIG. 1 is a perspective view of an exercise machine that is arranged and configured in accordance with certain features, aspects and advantages of the present invention.
Figure 2:
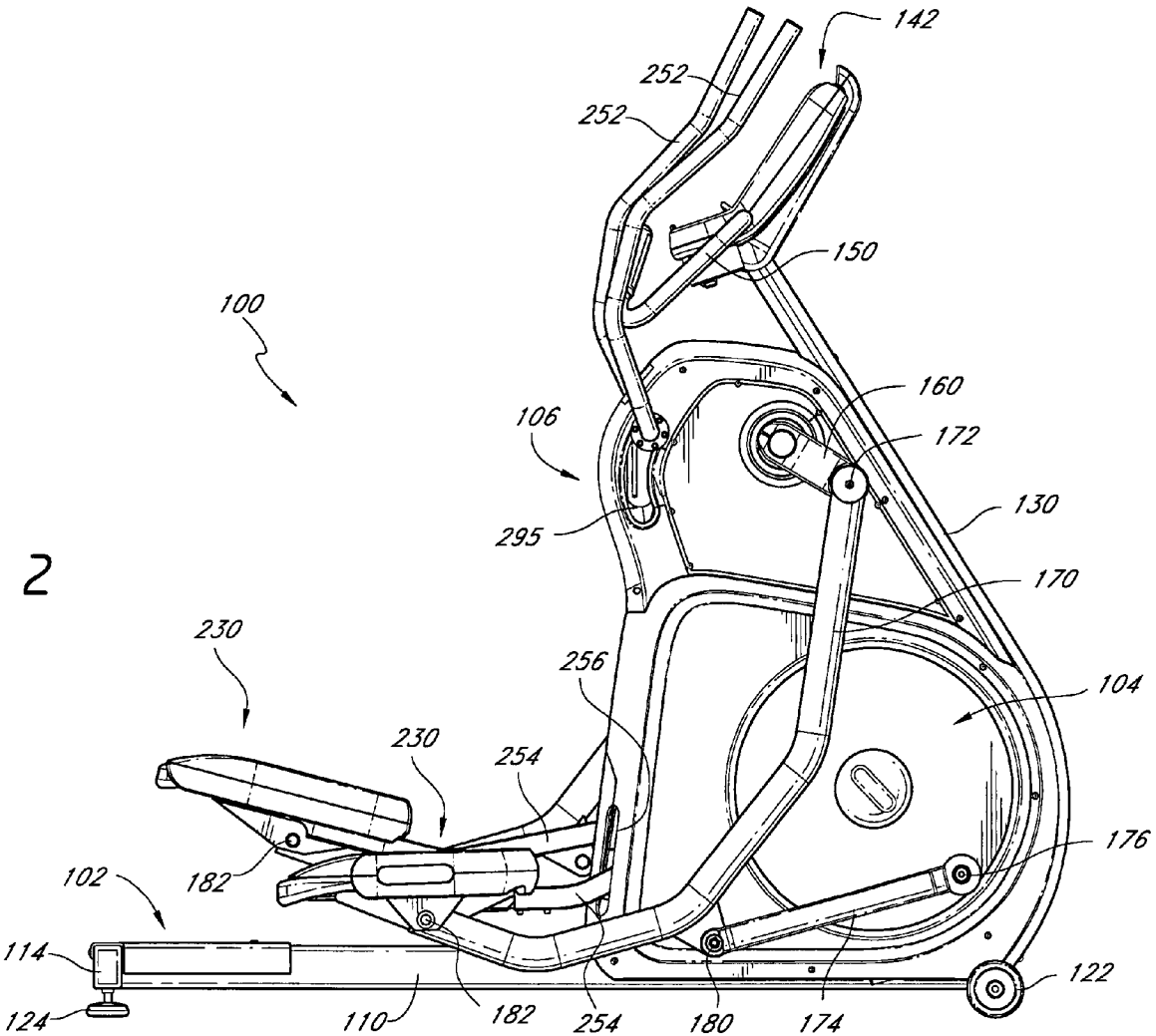
FIG. 2 is a right side elevation view of the exercise machine of FIG. 1.
Figure 3:
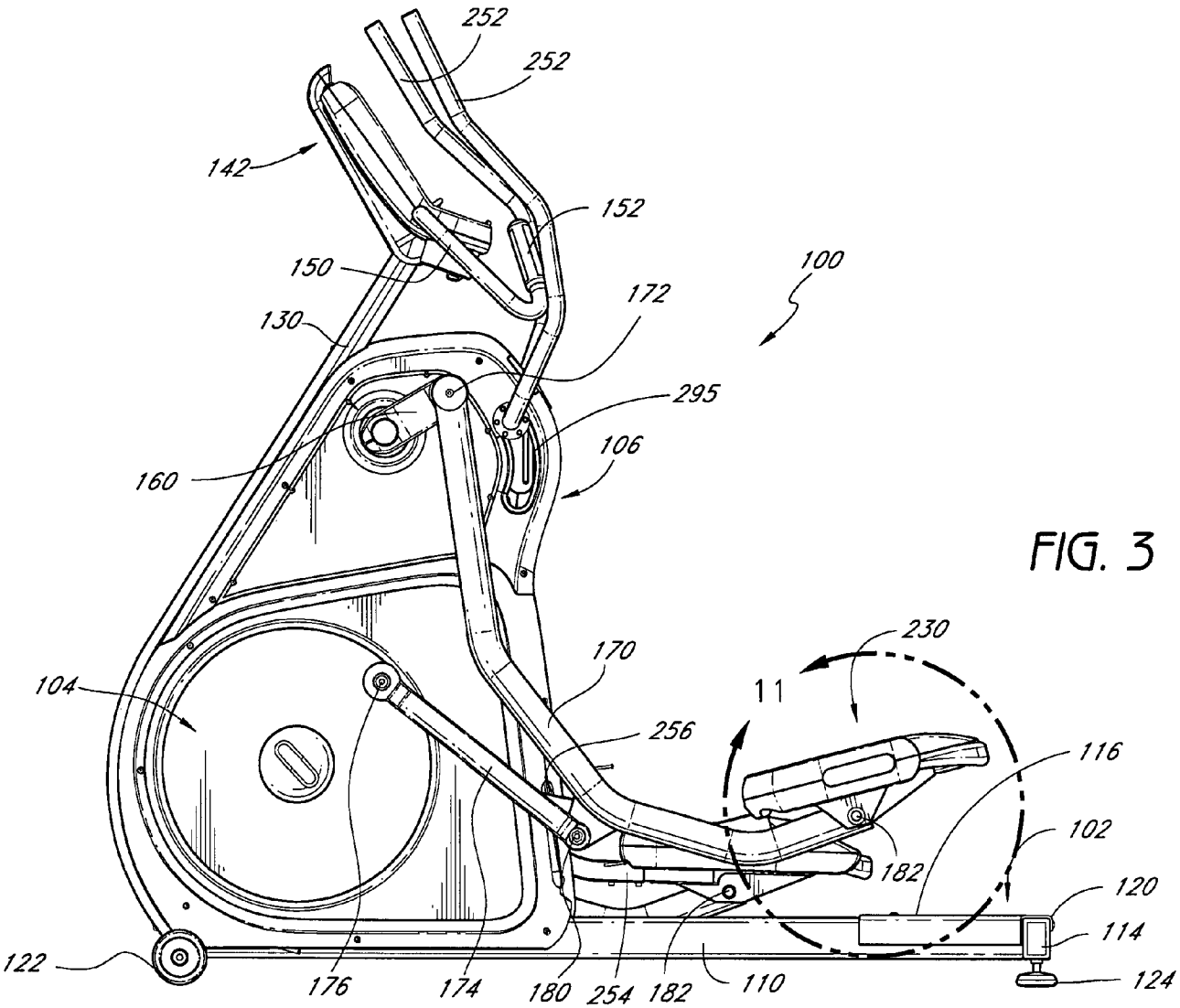
FIG. 3 is a left side elevation view of the exercise machine of FIG. 1.
Figure 5:
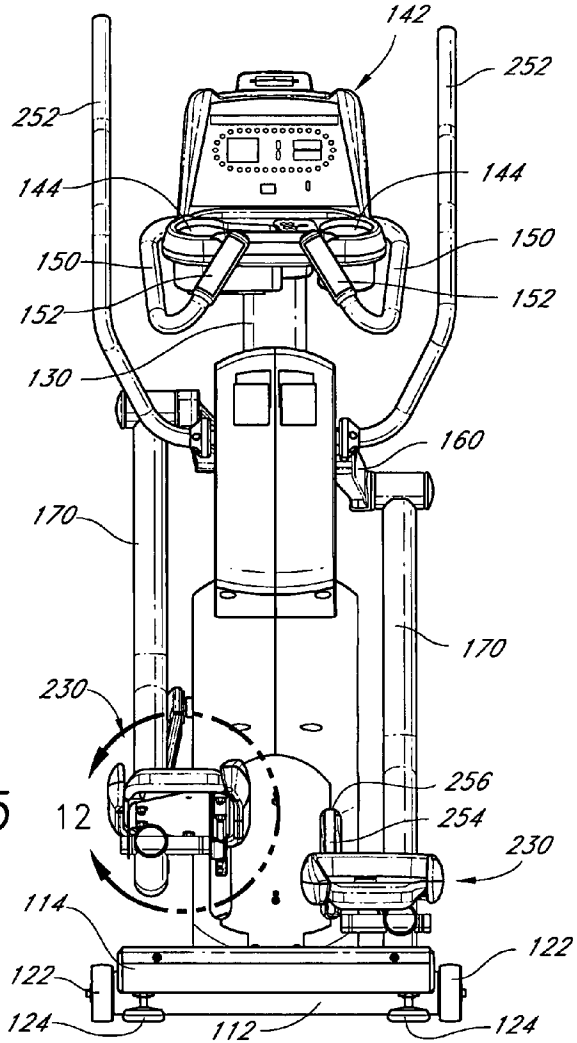
FIG. 5 is a rear side elevation view of the exercise machine of FIG. 1.
Figure 4:
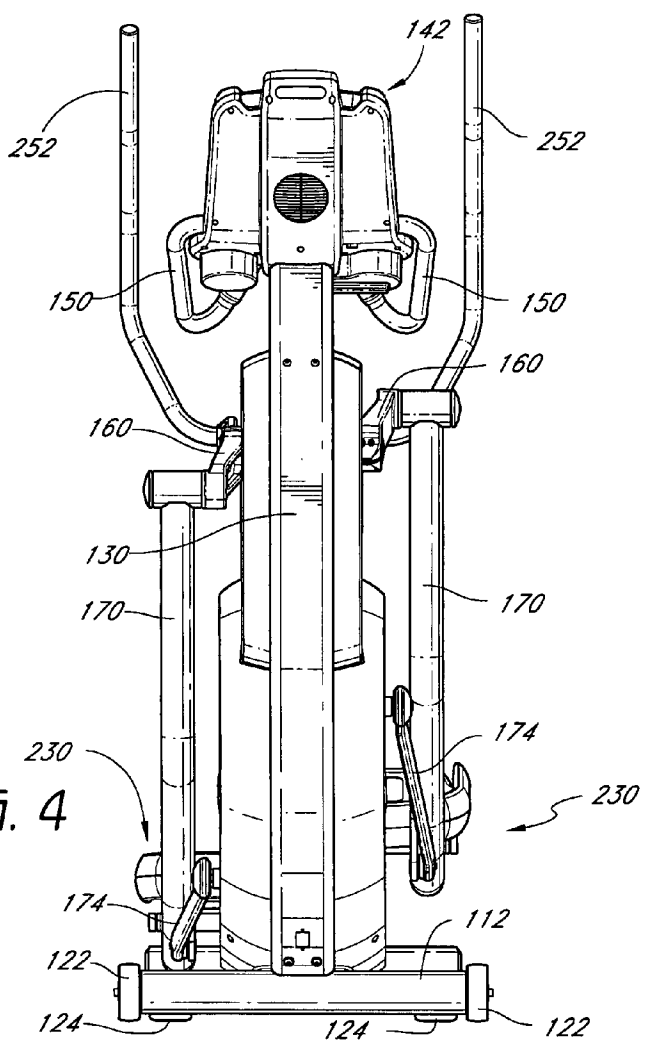
FIG. 4 is a front side elevation view of the exercise machine of FIG. 1.

With reference initially to FIGS. 1-7, the illustrated exercise machine 100 is adapted for stationary positioning on a floor during exercise. As such, the machine 100 comprises a frame assembly 102 that supports an operating linkage 104 (see FIG. 8 for a view of a majority of the frame assembly, FIG. 9 for a skeletal illustration of the operating linkage 104 and FIG. 10 for a clearer view of the integration of the frame 102 and the linkage 104). A housing 106 encloses a substantial portion of both the frame 102 and the linkage 104.

With reference now to FIG. 1, the frame 102 preferably comprises a longitudinally extending center beam 110. At the forward end of the center beam 110, a laterally extending front cross beam 112 is secured to the center beam 110. At the rearward end of the center beam 110, a rear cross beam 114 is secured to the center beam 110. Together, the center beam 110, the front cross beam 112 and the rear cross beam 114 define a support base. Other support base arrangements also can be used keeping in mind the desire for stability during use of the exercise machine 100.

Figure 6:
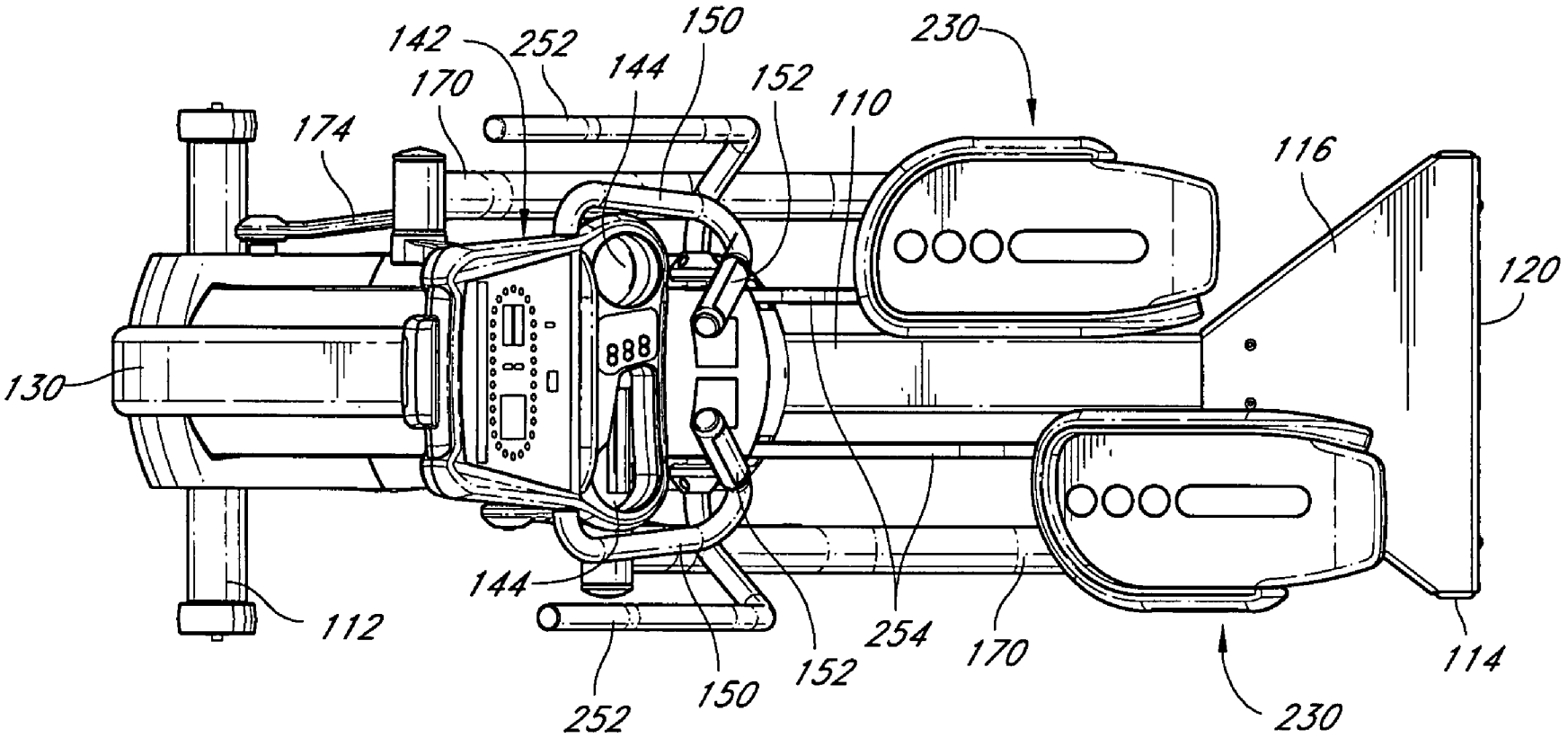
FIG. 6 is a top plan view of the exercise machine of FIG. 1.
Figure 7:
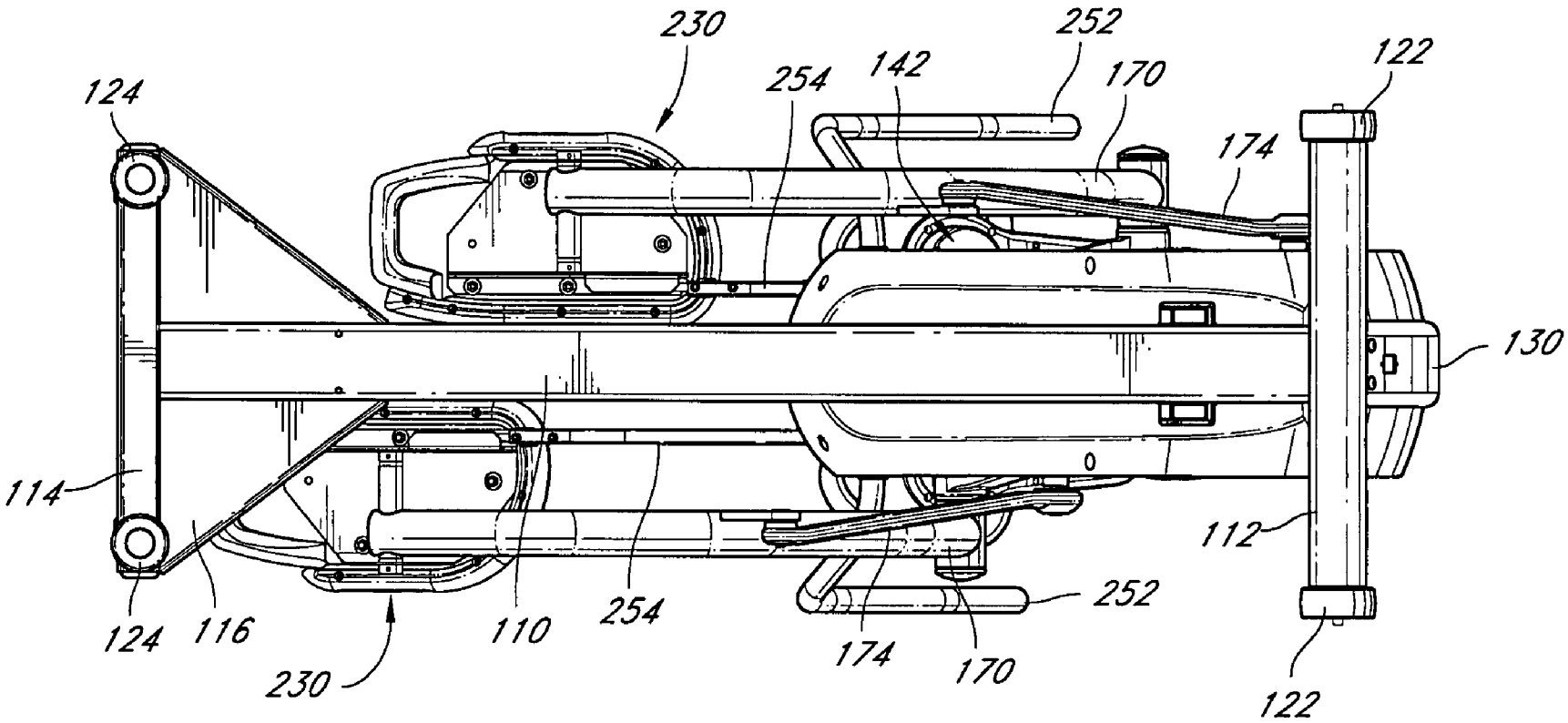
FIG. 7 is a bottom plan view of the exercise machine of FIG. 1.

With reference to FIG. 6, a rear platform 116 is positioned over the center beam 110 and a portion of the rear cross beam 114. The rear platform 116 can be omitted in some applications; however, in the illustrated embodiment, the rear platform 116 provides a convenient structure for mounting the exercise machine 100. The illustrated platform has a generally triangular shape; other configurations also can be used. Preferably, a rearmost end 120 of the platform 116 defines a rearmost extent of the exercise machine 100 during exercise. In other words, the operating linkage 104 preferably is positioned entirely forward of the rearmost end 120 of the platform 116 during all phases of exercise motion.

With reference again to FIG. 1, the illustrated machine 100 comprises a pair of forward rollers 122 (see also FIG. 6) and a pair of rear adjustable feet 124. The illustrated rollers 122 are mounted to the sides of the front cross beam 122 and the illustrated feet 124 are positioned under the rear cross beam 124. The placement of the rollers 122 and the feet 124 can be varied in other configurations. The adjustable feet 124 can be moved generally vertically in and out of the rear cross beam 124 to level the rear cross beam 124. In some configurations, the entire exercise machine 100 can be supported by adjustable feet. Such configurations, however, decrease the ability to easily reposition the exercise machine 100 within an exercise space for cleaning of the floor space or the like.

Figure 8:
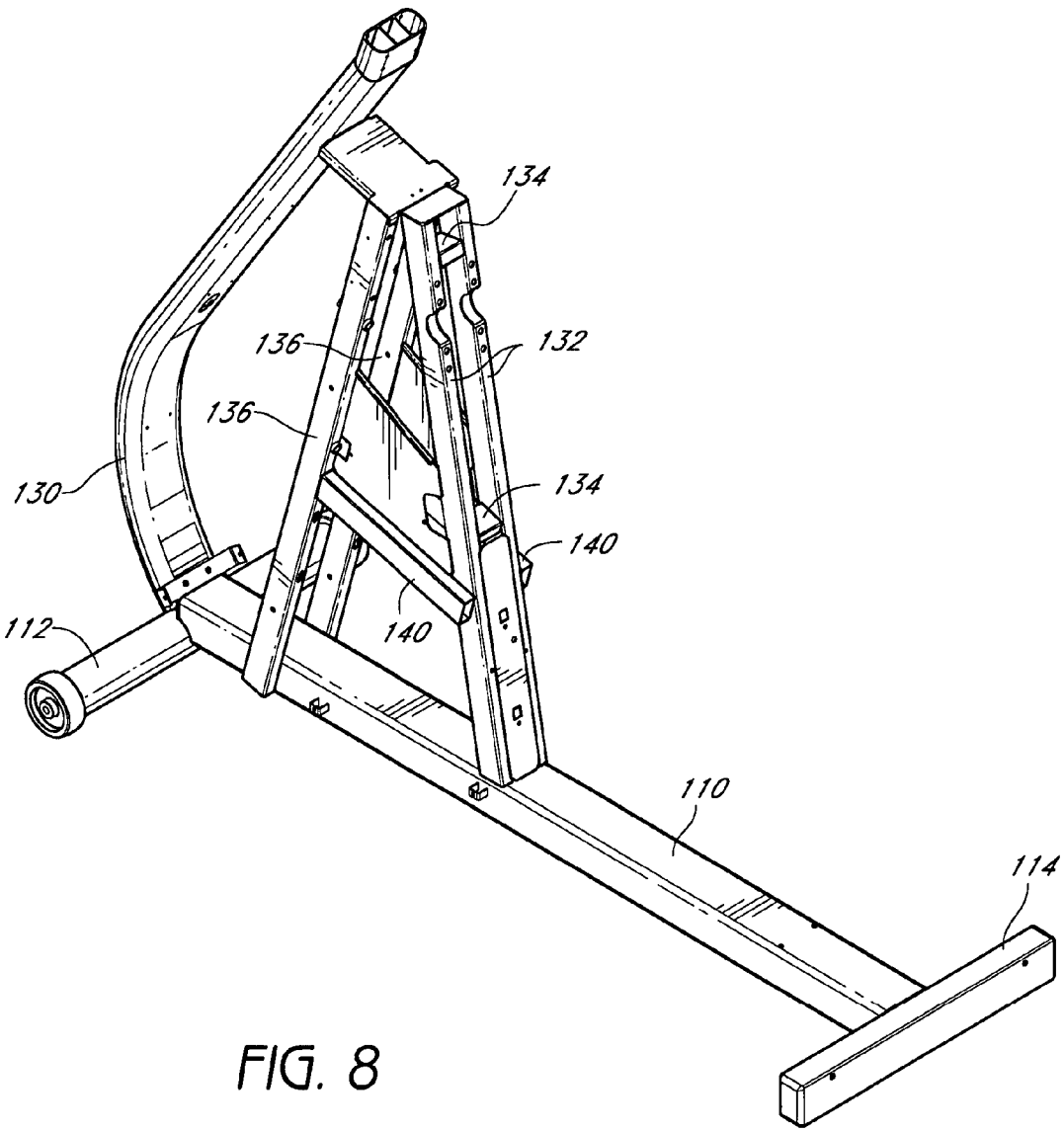
FIG. 8 is a top left perspective view of a portion of a frame assembly of the exercise machine of FIG. 1.

With reference now to FIG. 8, the frame assembly 102 preferably comprises one or more upright members. In the illustrated arrangement, a forward display standard 130 curves upward from the forward end of the center beam 110. The forward display standard 130 preferably is generally rectangular and more preferably is generally hollow such that the display standard 130 can form a conduit through which wires and the like can be routed. The illustrated display standard 130 is curved mainly for esthetic reasons.

Two rearward posts 132 extend upward along a central portion of the center beam 110. The posts 132 preferably slope slightly forward and are joined by one or more cross braces 134. Two intermediate posts 136 slope slightly rearward. Together, the intermediate posts 136 and the rearward posts 132 define a generally A-shaped upright frame that supports the illustrated operating linkage 104. One or more interconnecting braces 140 can be used to connect the intermediate posts 136 and the rearward ports 132. Other arrangements also can be used.

With reference again to FIG. 1, in the illustrated configuration, a display console 142 is connected to an upper end of the display standard 130. The display console 142 can have any suitable configuration. For instance, the display console 142 can be configured in a manner such as that set forth in copending U.S. patent application Ser. No. 10/299,625, filed on Nov. 19, 2002, which is incorporated by reference in its entirety. In the illustrated arrangement, the display console 142 allows information to be conveyed to and from a user in an interactive manner through a display screen, pushbuttons or the like. Moreover, the illustrated display console 142 comprises one or more receptacles 144 for holding water bottles, keys and other items that may be carried by users. The receptacles 144 also can be designed to incorporate features from copending U.S. patent Ser. No. 10/698,236, filed on Oct. 31, 2003, which is incorporated by reference in its entirety. Further, the illustrated display console 142 comprises an air duct outlet 146 that conveys toward a user air from a suitable cooling system. The display console 142 also can be configured to implement features from copending U.S. patent Ser. No. 10/299,627, filed on Nov. 19, 2002, which is incorporated by reference in its entirety.

The illustrated display console 142 also comprises a pair of stationary handles 150 that can include pulse rate sensors 152. The handles 150 extend downward toward a user before bending upward and inward. The handles 150 provide a comfortable location for a user's hands while exercising and the pulse rate sensors 152 allow the exercise machine 100 to monitor the pulse rate of a user for use in any suitable control routine or for display to the user. While a certain display console 142 has been shown and described, any suitable display systems can be used or, in certain less advantageous configurations, the display console can be entirely omitted. Moreover, while the illustrated exercise machine 100 comprises a pair of stationary handles 150, the handles can be relocated or omitted in some constructions.

The frame 102 supports the operating linkage 104, a mechanism which will be described initially with reference to the skeletal illustration of FIG. 9. The mechanism can generate a desired elliptical motion at a trace point. In the illustrated configuration, the mechanism can be considered a geared five bar mechanism, which is defined herein as a five bar linkage attached to a gear train, and the trace point can be considered the location of the foot of the user. In the illustrated configuration, the gears are replaced by a drive belt configuration designed such that the gears rotate in the same direction at generally the same speed. Other configurations may use a gear train (e.g., a three gear train) or another suitable mechanical coupling to clock the mechanism in timed relationship. As used herein, a five bar linkage is meant to have its ordinary meaning and can include any linkage having four moving links connected by a fixed ground line (hence 5 links) and a geared five bar linkage is meant to have its ordinary meaning and can include a five bar linkage, such as described directly above, with two of the moving links connected by a gear train, pulley drive, belt drive, chain drive or the like. In some configurations, the two moving links can be connected by a single link (e.g., a locomotive style system), another linkage or the like.

Figure 9:
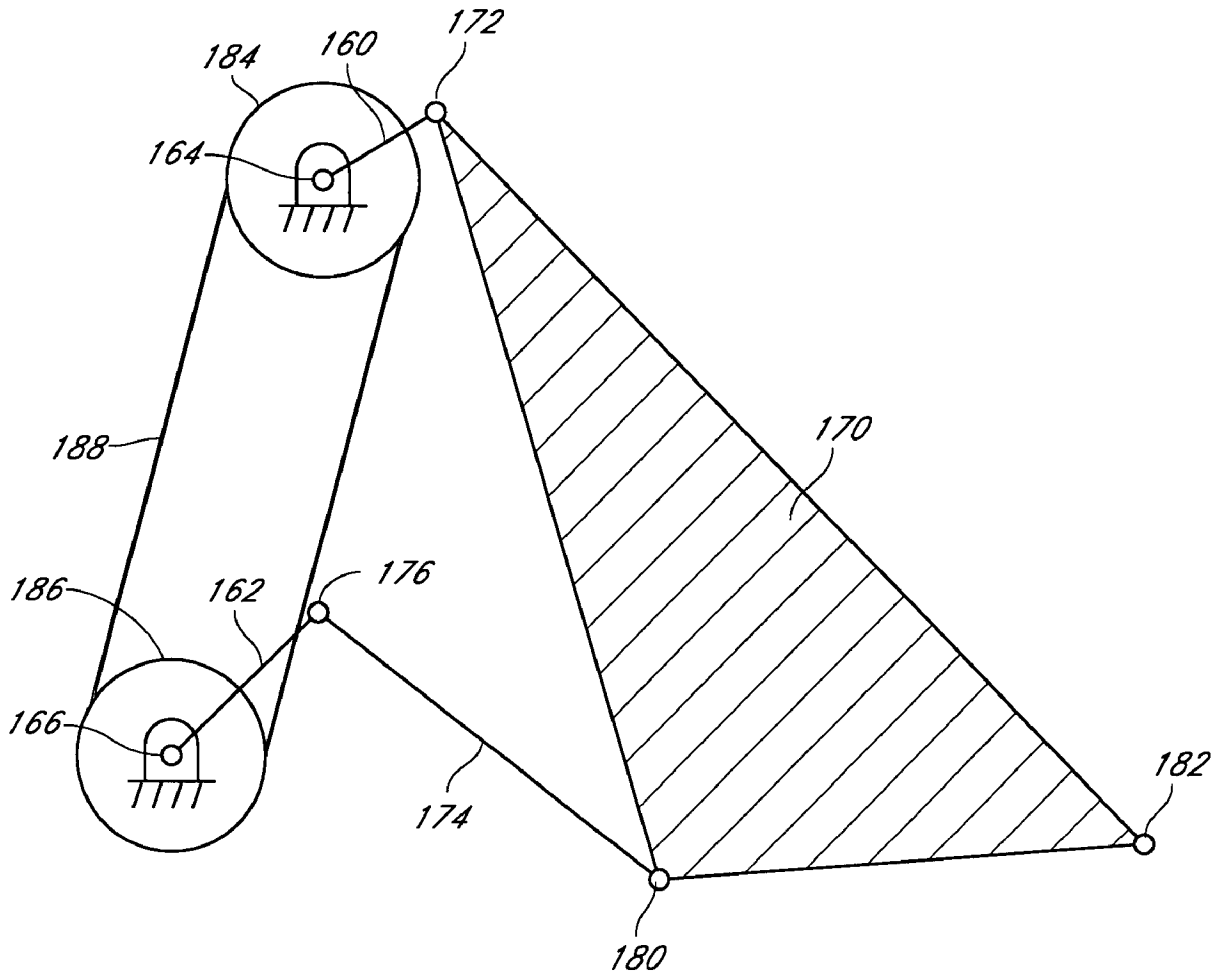
FIG. 9 is a skeleton view of a geared five bar mechanism used with the exercise machine of FIG. 1.

As illustrated in FIG. 9, the illustrated operating linkage 104 is actually a pair of operating linkages, one for the left foot and one for the right foot of a user. The two linkages 104 preferably are about 180 degrees out of phase. Other constructions can be used and, in some configurations, the operating linkages 104 can be separately operated and are not coupled together. For clarity and ease of description, only one of the two linkages 104 will be described in detail.

Figure 10:
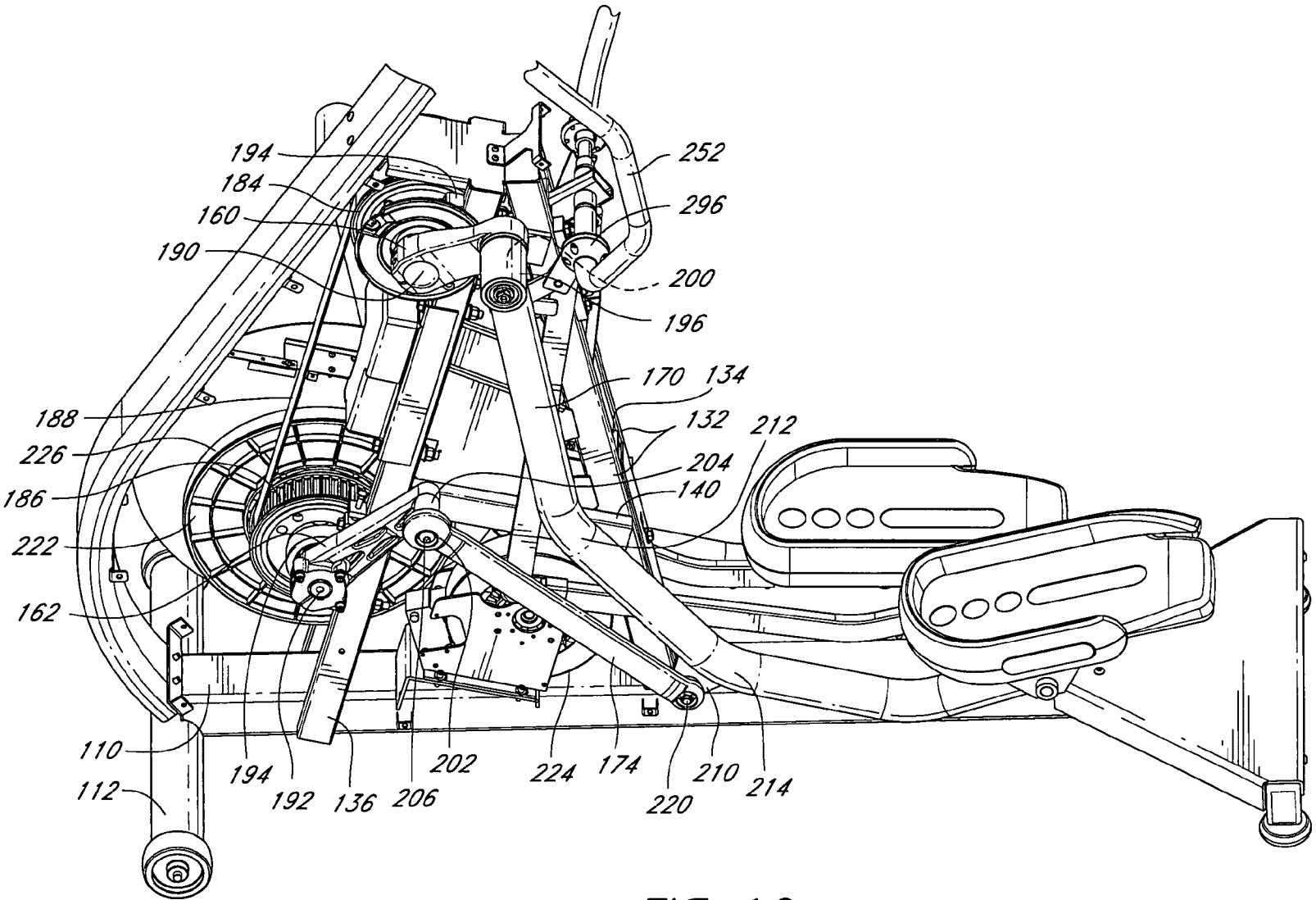
FIG. 10 is a top left perspective view of a lower forward portion of the exercise machine shown in FIG. 1 with some components, including a housing, a display, various covers and the like, removed for clarity.

Preferably, the operating linkage 104 comprises four moving links and a fixed "ground link," which results in five revolute, pivoted or pin joints. The "ground link" in the illustrated arrangement is formed by the frame assembly 102. The five bar mechanism preferably is largely, if not wholly, positioned within the region of the frame assembly 102. More preferably, a large portion of the operating linkage 104 is enclosed within the housing 106. Even more preferably, as illustrated in FIG. 10, all but one of the moving joints between the links in the illustrated arrangement are positioned forward of the rearward upright posts 132.

Figure 15:
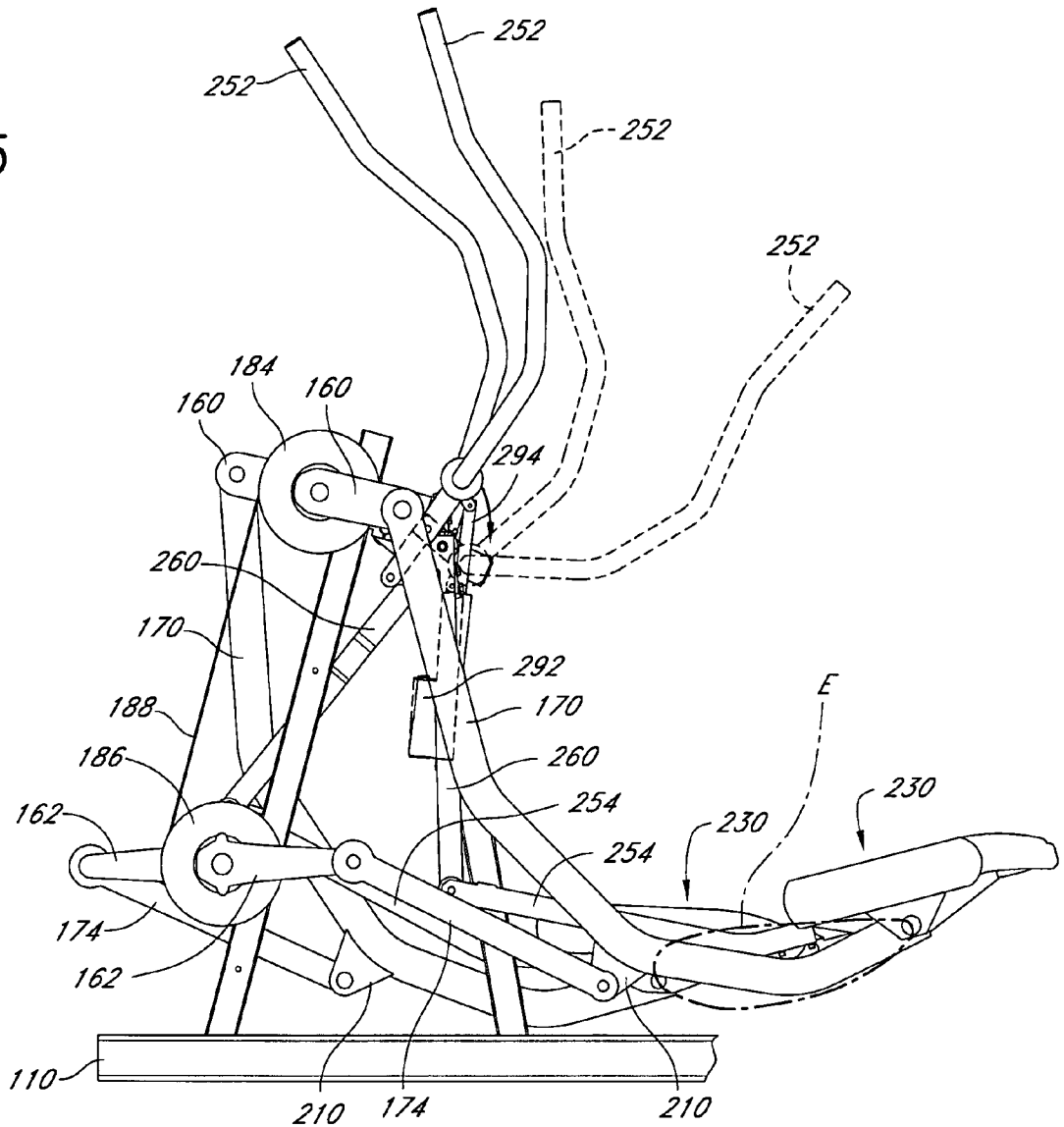
FIG. 15 is a simplified left side elevation view of the exercise machine of FIG. 1 showing a generally elliptical foot trace and shown a varying range of motion for the arm handles.

With reference to FIG. 9, the operating linkage 104 preferably comprises an upper crank 160 and a lower crank 162. The upper crank 160 rotates about an upper fixed rotational axis 164 to which a first end of the upper crank 160 is connected and the lower crank 162 rotates about a lower fixed rotational axis 166 to which a first end of the lower crank 162 is connected. A first end of a first coupler link 170 is joined to a second end of the upper crank 160 with a first pin joint 172. A first end of a second coupler link 174 is joined to a second end of the lower crank 162 with a second pin joint 176. A third pin joint 180 joins a second end of the first coupler link 174 and a second end of the second coupler link 174. The first coupler link 170 further comprises a trace point 182, which generally corresponds to a location of a support for a user's foot. During movement of the operating linkage 104, the trace pint 182 follows a desired generally elliptical path. As such, when implemented on the exercise machine 100, the operating linkage 104 creates a substantially elliptical trace E for a user's foot, as shown in FIG. 15. The substantially elliptical trace that is generated can be varied by altering the lengths of the links 160, 162, 170, 174, the spacing and/or relative positioning of the ground points (e.g., 164, 166) or by adjusting the phase angle between the cranks 160, 162.

As discussed above, the operating linkage 104 preferably comprises a geared five bar mechanism. With reference to FIGS. 9 and 10, the operating linkage 104 also comprises an upper pulley 184, a lower pulley 186 and a flexible transmitting member 188 that wraps around both pulleys 184, 186. In a preferred arrangement, the pulleys 184, 186 have the same outer diameter such that both pulleys move at the same speed. Moreover, to simplify the construction, the upper pulley 184 preferably rotates about the upper fixed rotational axis 164 while the lower pulley 186 preferably rotates about the lower fixed rotational axis 166. The upper crank 160 can be secured to the upper pulley 184 for rotation with the upper pulley 184 and the lower crank 162 can be secured to the lower pulley 186 for rotation with the lower pulley 186. In some embodiments, the cranks can be omitted and the joints (e.g., 170, 176) can be formed as a structure part of the pulleys. As used herein, the term cranks is intended to be given its ordinary meaning and can include constructions in which a crank is integrated into a pulley. Regardless of whether the cranks are integrated into the pulleys or not, the cranks 160, 162 desirably rotate synchronously with each other. As will be described, the cranks 160, 162 can be positioned out of phase relative to each other but the cranks 160, 162 preferably are still synchronized to rotate at the same speed, even if out of phase.

Thus, as described above, the operating linkage 104 for each foot of a user preferably comprises four moving links (160, 162, 170 and 174) that are connected by three joints (172, 176, 180) with two of the four links connected by two additional joints (164, 166) to ground locations defined by the axes 164, 166, which are fixed relative to the frame assembly 102. The operating linkage 104 for each foot also comprises a clocking configuration, such as the belt 188 and the pulleys 184, 186, that connects two of the four links (e.g., 160, 162) for timed movement. The clocking configuration governs the movement of the pin joint 180 along a predetermined path. It is contemplated that a guiding structure also can be used to dictate the movement of the pin joint 180 along a predetermined path and, in such configurations, the belt drive may be omitted. For instance, a guide plate with a desired guide path, slot or groove formed in the guide plate can be used to guide the pin joint 180 along the predetermined path. As described herein, the clocking configuration and the guide plate configure define means for controlling a path of movement of at least one pin joint of a five bar mechanism.

With reference now to FIG. 10, the exercise machine 100 is illustrated with certain components omitted such that the operating linkage 104 can be better shown. As illustrated, the upper fixed rotational axis 164 is defined by an upper axle 190 and the lower fixed rotational axis 166 is defined by a lower axle 192. In the illustrated arrangement, pillow block bearings 194 secure the axles 190, 192 to the frame assembly 102. In particular, the pillow block bearings 194 are mounted to the intermediate posts 136 in the illustrated configuration.

The upper crank 160 is mounted to the upper axle 190. The lower crank 162 is mounted to the lower axle 192. As illustrated, the cranks 160, 162 of the opposing sides of the exercise machine 100 preferably are mounted about 180 degrees out of phase from each other. In the illustrated arrangement, the upper pair of cranks 160 are positioned vertically higher than the lower pair of cranks 162 and the upper pair of cranks 160 are positioned rearward of the lower pair of cranks 162. Other crank placements and orientations also can be used keeping in mind the desire for a usable foot trace.

The first coupler link 170 has a generally tubular configuration. At the first end, the first coupler link 170 comprises a sleeve 196. A stub shaft 200 extends outward from the illustrated upper crank 160 and the sleeve 196 is positioned over the stub shaft 200. The sleeve 196 allows the stub shaft 200 to rotate within the sleeve such that the end of the first coupler link moves up, down, forward and rearward with the rotation of the stub shaft 200 about the upper axle 190, thereby defining the first pin joint 172. Any suitable connection between the first coupler link 170 and the upper crank 160 can be used keeping in mind the goal of creating up, down, forward and rearward movement of the first end of the first coupler link 170 while the upper crank 160 rotates about the upper fixed rotational axis 164 defined by the upper axle 190.

The second coupler link 174 has a generally bar-like configuration. At the first end, the second coupler link 174 also comprises a head 202. The lower crank 162 has a boss 204. The head 202 is connected to the boss 204 by a mechanical fastener 206 or the like. Any suitable connection can be used keeping in mind the goal of creating up, down, forward and rearward movement of the first end of the second coupler link 174 while the lower crank 162 rotates about the lower fixed rotational axis 166 defined by the lower axle 192, thereby defining the second pin joint 176.

The first coupler link 170 comprises a tab 210 that can be positioned at an intermediate portion of the illustrated first coupler link 170. In the illustrated arrangement, the first coupler link 170 comprises a bent tubular member. In particular, from the end of the first coupler link 170 that comprises the sleeve 196, the illustrated first coupler link 170 comprises a first bend 212, a second bend 214 and a third bend 216. The tab 210 is positioned proximate the second bend 214.

The second end of the second coupler link 174 preferably is pivotally connected to the tab 210. In the illustrated embodiment, the second coupler link 174 is secured to the tab 210 by a mechanical fastener 220. Any other suitable technique can be used to secure the second coupler link 174 to the first coupler link 170 keeping in mind the goal of providing a pivot connection between the first and second coupler links 170, 174, thereby defining the third pin joint 180.

As illustrated, an upper pulley 184 preferably is secured to the upper axle 190 such that the upper pulley 184 and the upper axle 190 rotate together while a lower pulley 186 is secured to the lower axle 192 such that the lower pulley 186 and the lower axle 192 rotate together. The pulleys 184, 186 and the axles 190, 192 can be secured together in any suitable manner. Preferably, the pulleys 184, 186 have the same effective diameter such that the axles 190, 192 will rotate at the same speed. In some configurations, one or both of the pulleys can have an adjustable effective diameter (e.g., a continuously variable transmission type of pulley) such that the relative rotational speeds or the relative orientations can be adjusted to alter the driven motion. A belt, chain, cord or other flexible transmitter 188 interconnects the two pulleys 184, 186, such that the two pulleys 184, 186 rotate together.

With continued reference to FIG. 10, a secondary pulley 222 is provided on the lower axle 192. The secondary pulley 222 can be provided in other locations; however, mounting the secondary pulley 222 to the lower axle 192 provides a compact configuration. The secondary pulley 222 cooperates with an electronic or mechanical brake 224. The brake 224 comprises a pulley and a flexible transmitter 226 interconnects the secondary pulley 222 with the pulley of the brake 224. The brake 224 can be any suitable component that resists movement of the operating linkage 104. In some configurations, separate brakes can be provided for each side of the exercise machine 100. In other configurations, separate brakes can be provided for the upper axle 190 and the lower axle 192. In yet other configurations, the brake 224 can be replaced by a component (e.g., a motor/generator) that can drive the operating linkage 104 at varying rates of speed.

Figure 12:
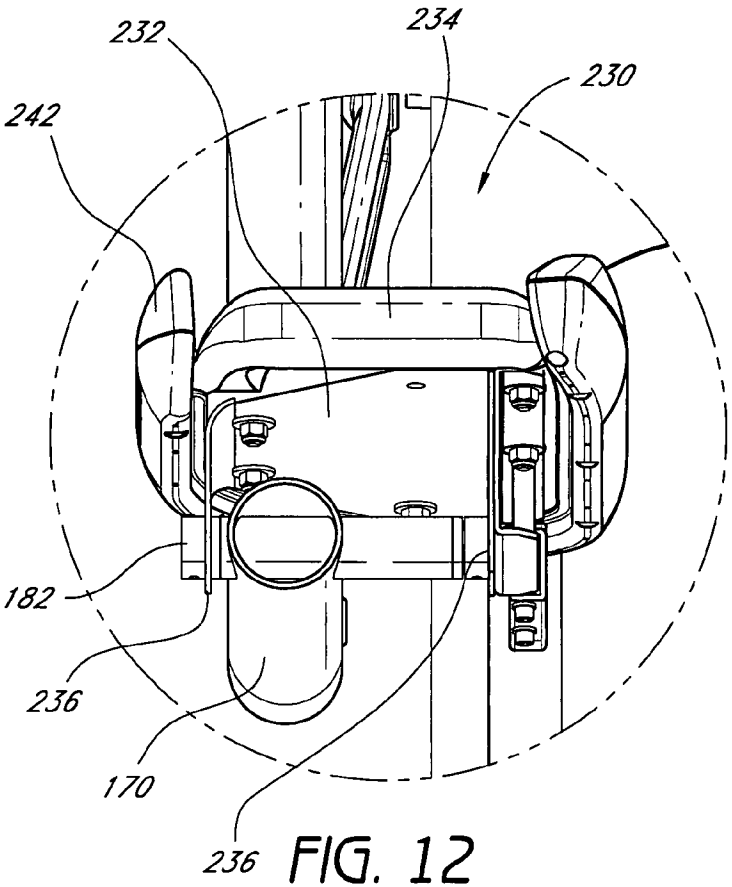
FIG. 12 is an enlarged rear side elevation view taken from the circle 12 in FIG. 5 and showing the foot support of FIG. 11.
Figure 11:
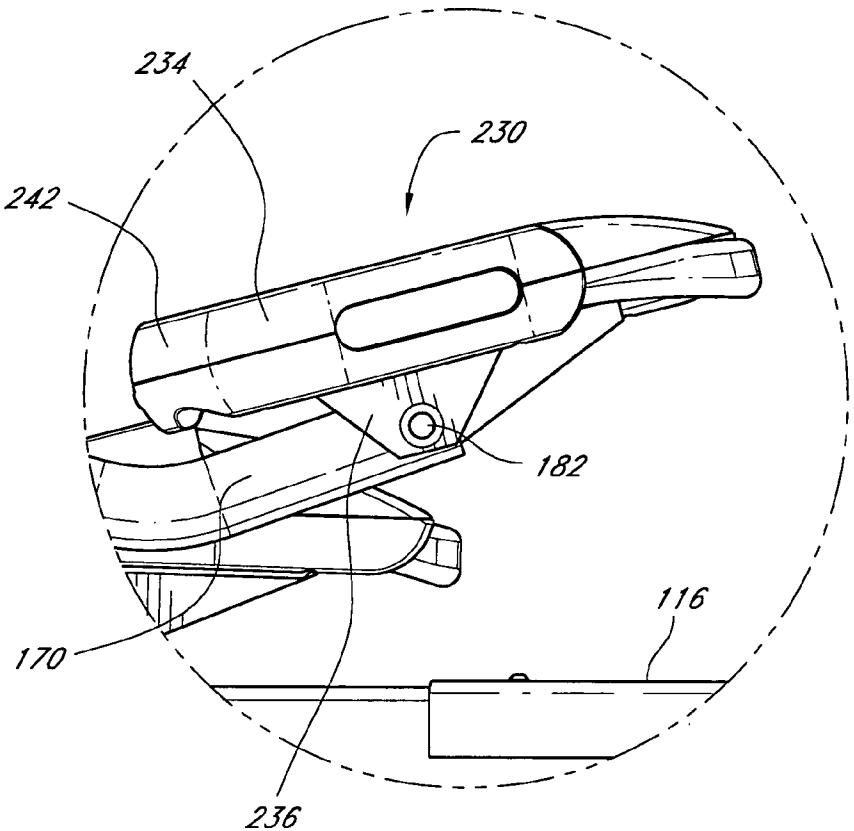
FIG. 11 is an enlarged left side elevation view taken from the circle 11 in FIG. 3 and showing a foot support used with the exercise machine shown in FIG. 1.

A foot support 230 is connected to the second end of each first coupler link 170. Thus, two foot supports 230 are provided, which are connected respectively to the left and right first coupler links 170. Preferably, the foot supports 230 are pivotable relative to the first coupler link 170. With reference to FIGS. 11 and 12, the illustrated foot supports 230 comprise a base plate 232 and a foot pad 234. The illustrated base plate 232 comprises a pair of downwardly depending ears 236. The ears 236 are used to secure the base plate 232 to the second end of the first coupler link 170. In one configuration, a shaft 240 extends through apertures formed in the ears 236 and corresponding apertures formed in the first coupler link 170. Any other suitable configuration can be used to mount the foot supports 230 to the operating linkage 104.

The foot pad 234 can be formed of any suitable material. In one configuration, the foot pad 234 is rubberized to provide cushioning as well as a skid-resistant surface. Moreover, the foot pad 234 preferably comprises an upstanding wall 242. The upstanding wail 242 preferably extends around at least a portion of the foot pad 234. In one preferred configuration, the wall 242 extends around an inner edge, a forward edge and a portion of an outer edge of each foot pad 234.

The exercise machine 100 also comprises adjustable arm linkages 250. Each of the arm linkages 250 connects a pair of handles 252 to the operating linkage 104. Advantageously, the arm linkages 250 enable movement of the handles 252 to be adjusted. In some configurations, the handles 252 can be brought to a stop. In some other configurations, the sweep angle of the handles 252 can be increased or decreased as desired. Preferably, in either configuration, the handles 252 are moveable in a synchronized relationship with the operating linkage 104.

Each of the arm linkages 250 comprises a lower strut 254 that is secured to a suitable region of the operating linkage 104. In the illustrated arrangement, the strut 254 is secured to the foot support 230. Any suitable structure can be used to connect the strut 254 and the operating linkage 104 keeping in mind the desire to create movement of the strut 254 through movement of the operating linkage 104. By connecting the lower strut 254 to the pivotally mounted foot support 230, movement of the foot support 230 can be somewhat controlled by the interrelationship of the arm linkage 250 and the operating linkage 104. In other words, the illustrated arrangement allows pivotal movement of the foot supports 230 relative to the operating linkage 104 to be forced.

As best shown in FIG. 6, the lower strut 254 extends forward of the foot support 230 and through an opening 256 defined in the housing 106. With reference again to FIG. 11, a lower end of a lever 260 is pivotally connected to the forward end of each of the lower struts 254. Any suitable pivotal connection can be used. An upper end of the lever 260 can be pivotally connected to the frame assembly 102 at a pivot point 261. In the illustrated arrangement, the upper end of the lever 260 is pivotally mounted by bearings 262 that are secured to the rearward posts 132 of the frame assembly 102. Thus, the levers 260 can swing forward and rearward with movement of the foot supports 230 and the associated components of the operating linkage 104.

A flange 264 extends forward from an upper portion of the illustrated lever 260. The flange 264 can be integrally formed with the lever 260; however, in the illustrated arrangement, the flange 264 is a separate component that is secured to, the lever 260 in any suitable manner. For instance, but without limitation, the flange 264 can be welded to the lever 260, secured to the lever 260 by mechanical interlock, by mechanical fastener or any combination of these techniques.

A first end of a coupler link 266 is pivotally connected to the flange 264. In the illustrated arrangement, the flange 264 comprises a short shaft and the coupler link 266 comprises an aperture through which the shaft extends. A circlip is used to secure the coupler link 266 onto the shaft of the flange 264.

A second end of the coupler link 266 is pivotally connected to a rocker link 270 at a pivot point 271. The rocker link 270 is secured to a sleeve 272. In the illustrated arrangement, the rocker link 270 is welded to the sleeve 272 and the rocker link 270 is pinned to the coupler link 266. Due to the illustrated linkage, movement of the foot supports 230 is conveyed through the linkage to the sleeve 272. Thus, the sleeve 272 pivots about an axis S (i.e., rotation in a first direction followed by counter-rotation in a second direction) as the foot supports 230 move forward and rearward along a path dictated by the operating linkage 104.

As will now be explained, the sleeves 272 have movement that can have a varying angular dimension. In other words, the movement of the sleeves 272 can be increased and decreased such that larger or small arcs are swept by the movement of the sleeves 272. In short, the movement is varied by adjusting the location of the pivot point 271 between the coupler link 266 and the rocker link 270 relative to the location of the pivot point 261 between the lever 260 and the frame assembly 102. When the two pivotal points 261, 271 are aligned, or close to being aligned, the sleeves 272 are stationary or substantially stationary. As the pivot points 261, 271 are increasingly moved out of alignment, the sweep of each of the sleeves 272 increases in range.

Figure 14:
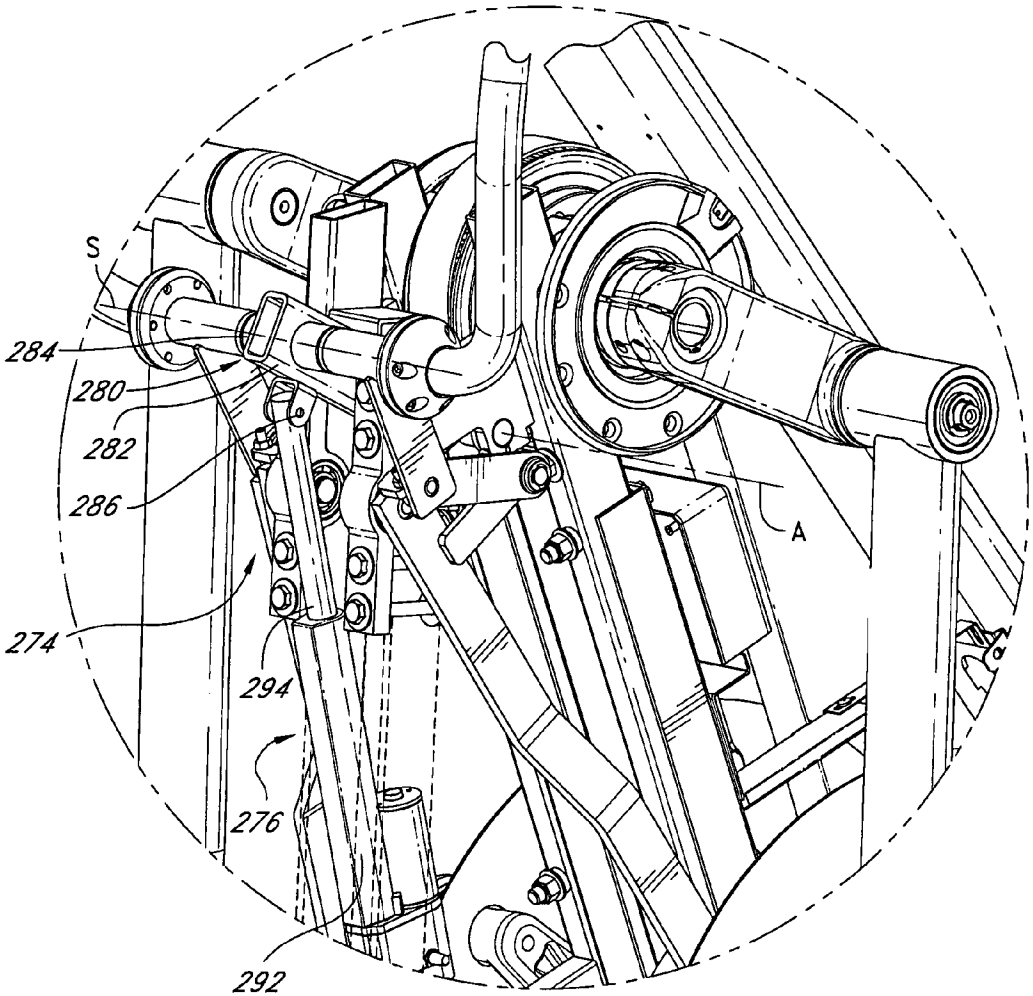
FIG. 14 is an enlarged top right perspective view of the lower portion of the exercise machine taken from the circle 14 in FIG. 13 with some components removed or shown in broken lines for clarity.

In the illustrated arrangement, relative movement of the pivot points 261, 271 is controlled through an adjustment mechanism 274. For clarity, the adjustment mechanism 274 is shown in FIG. 14. As illustrated, the adjustment mechanism 274 comprises an actuator 276 and a tie assembly 280. The tie assembly 280 of the illustrated arrangement guides movement of the pivot axis S. In particular, the illustrated arrangement uses the tie assembly 280 to guide the pivot axis S about a secondary pivot axis A. The movement is controlled with the actuator 276.

The tie assembly 280 can have any suitable configuration keeping in mind the desire to alter the relative position of the pivot points 261, 271. The illustrated tie assembly 280 generally comprises a lever 282 and a support bar 284. The lever 282 is formed of rectangular tube stock in the illustrated arrangement with the support bar 284 extending through a first end of the lever 282. The second end of the lever 282 is pivotally mounted to a bracket that is secured to the frame assembly 102. Thus, the second end of the lever 282 pivots about the axis A.

The sleeves 272 of the arm linkages 250 are mounted on the ends of the support bar 284. In some configurations, the sleeves 272 are mounted on bushings or bearings to allow improved relative movement between the sleeves 272 and the support bar 284. In other configurations, materials are selected for the sleeves 272 and the support bar 284 to provide sufficiently smooth relative movement between the members.

Figure 13:
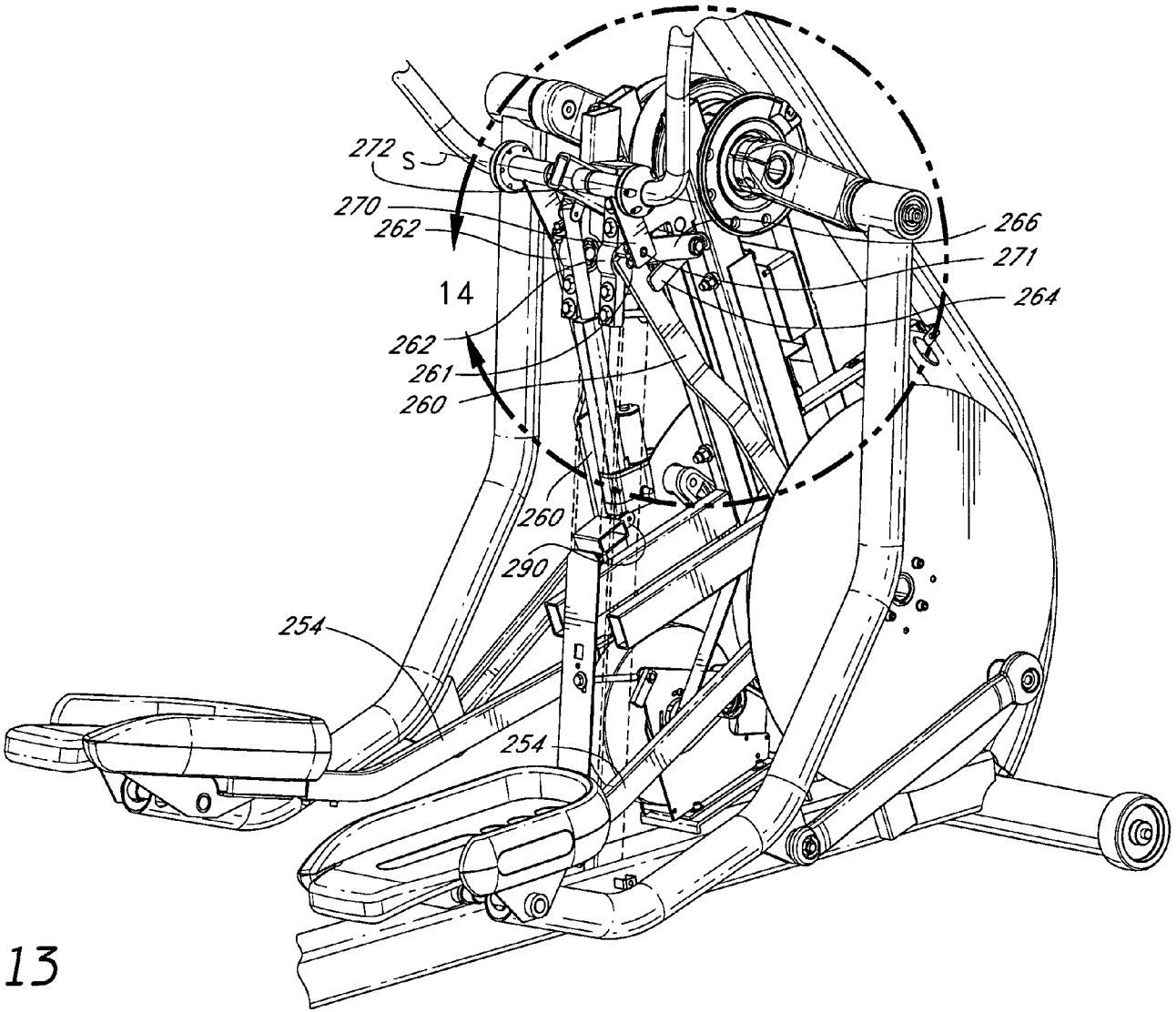
FIG. 13 is a top right perspective view of the lower forward portion of the exercise machine shown in FIG. 1 with some components, including the housing and some of the frame assembly, removed or shown in broken lines for clarity.

An upper bracket 286 is secured to the lever 282. A lower bracket 290 (see FIG. 13) is secured to the frame assembly 102. As described below, the actuator 276 can be any suitable component. In the arrangement shown in FIG. 14, an electromechanical actuator 292 is mounted between the lower bracket 290 and the upper bracket 286. The electromechanical actuator 292 comprises a lead screw 294 that is driven by an electric motor. The lead screw 294 can be used for extension and contraction. As the electromechanical actuator 292 extends, the lever 282 is pivoted upward. As the electromechanical actuator 294 contracts, the lever 282 is pivoted downward. This movement of the lever alters the relationship between the pivot points 261, 271, which alters the sweep of the sleeves 272. Furthermore, the movement of the lever 282 also adjusts the location of the pivot axis S such that it is closer to the user when the sweep angle of the sleeves 272 is the greatest and it is further from the user when the sweep angle of the sleeves 272 is the smallest. While the electromechanical actuator 292 is the actuator 276 in the illustrated configuration, other actuators and mounting configurations also are possible. For instance, hydraulic cylinders, air cylinders, other forms of worm gears, other forms of linear actuators and the like can be used as the actuator and, in some configurations, the pivot axis S can move along a non-arcuate path. Advantageously, the movement of the sleeves 272 about the arcuate path, or any other desired path shape, is accommodated by a suitably shaped opening 295 in the housing 106.

With reference again to FIG. 10, the handles 252 are coupled to the sleeves 272 in any suitable manner. As such, movement of the sleeves 272 generates corresponding movement of the handles 252. In some configurations, movement of the handles 252 can provide an input into the operating linkage 104 rather than being driven as an output of the operating linkage 104. Because the sleeves 272 are driven through a variable sweep angle, the movement of the handles 252 is adjustable among various sweep angles, including, in some configurations, a locked position in which the handles 252 do not move. Two positions are shown in FIG. 15, with one position shown in solid lines and another shown in dashed lines. The positions shown in FIG. 15 represent extremes of movement such that the handles 252 sweep back and forth from the first solid position to the second solid position or from the first dashed position to the second dashed position.

In the illustrated arrangement, collars 296 are secured to hubs 300 that are fixed to the sleeves 272. The collars 296 are secured to the handles 252 in any suitable manner. Thus, the handles 252 are easily replaceable for maintenance purposes. While not illustrated, the handles 252 can comprise heart rate sensors or the like, if desired.

In use, the user stands upon the foot supports 230 and imparts movement to the foot supports 230. The movement of the foot supports 230 results in either forward or rearward movement of the foot supports 230 through a generally elliptical foot trace. As the foot supports 230 are moved, the cranks 160, 162 rotate. Rotation of the cranks 160, 162 is input into the braking device 224. Moreover, the braking device 224 can be used to provide variable-level and/or fixed-level resistance to movement of the foot supports 230, if desired. In some configurations, a motor/generator can be used such that movement of the foot supports 230 can be driven by the machine such that a user moves along with or overdrives the movement provided by the exercise machine.

With reference now to FIGS. 16-26, a linkage 500 for another exercise machine is shown in skeleton view. The linkage shown in each of FIGS. 16-26 comprises the same components, which will be identified with reference numerals only on FIG. 16 for clarity. Also for clarity, the illustrated linkage 500 is shown for only one side of the machine 100 but can be replicated for both sides of the machine 100. Moreover, the linkage 500 can be mounted to the structure of the exercise machine shown in FIGS. 1-15 by mounting the pivot locations in manners as shown in FIGS. 1-15. As such, the linkage 500 can define a portion of the machine 100 in some configurations.

The illustrated linkage 500 advantageously is configured to cantilever its foot supports so that it also admits of a smaller machine foot print while providing desire foot traces at the foot supports. Even more advantageously, the illustrated linkage 500 is configured to allow the foot traces to be altered in desired manners. For instance, in one configuration, the foot traces can be varied between generally horizontal traces (e.g., see FIG. 16) and generally vertical traces (e.g., see FIGS. 17 and 24).

Figure 16:
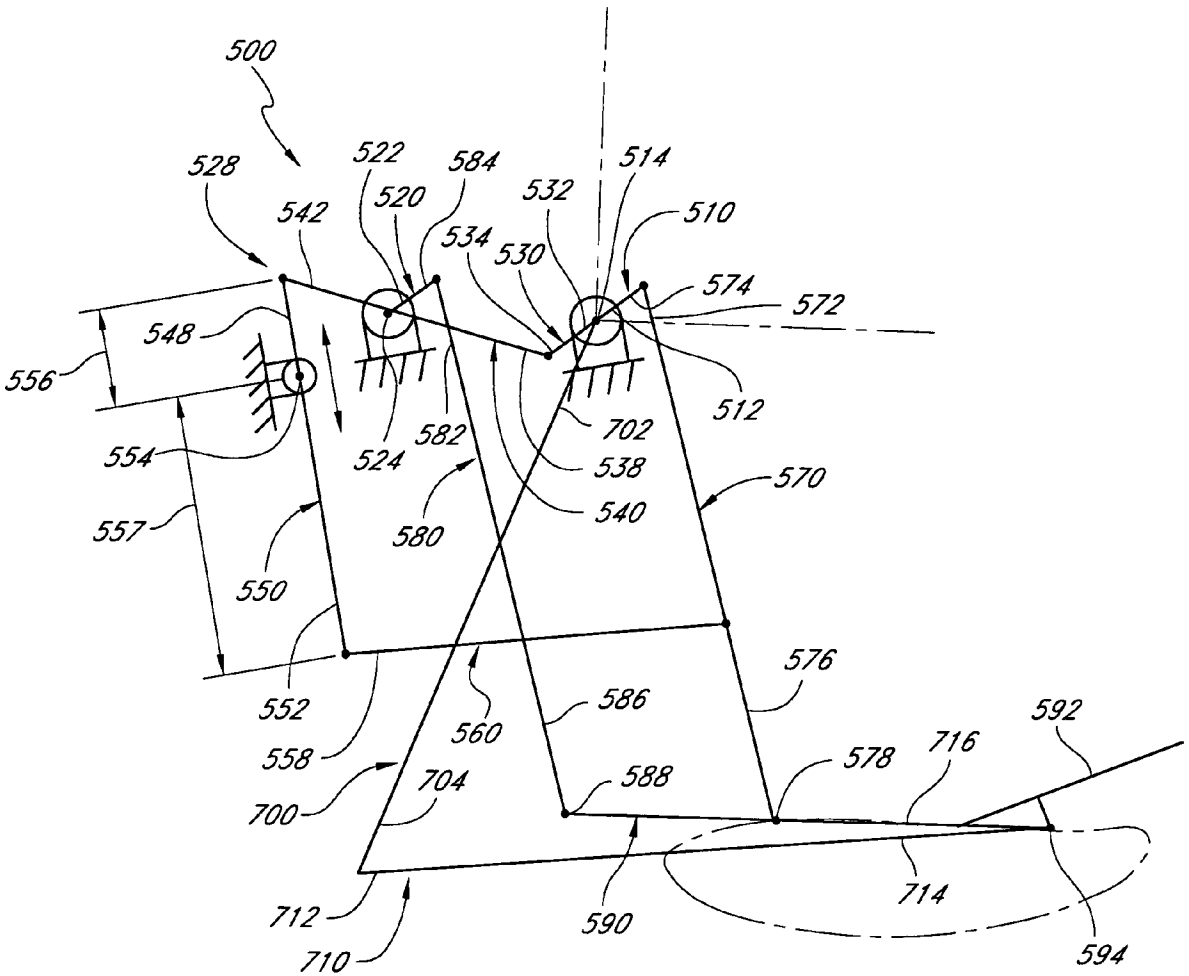
FIG. 16 is a skeleton view of a mechanism used with another exercise machine that is arranged and configured in accordance with certain features, aspects and advantages of the present invention.
Figure 17:
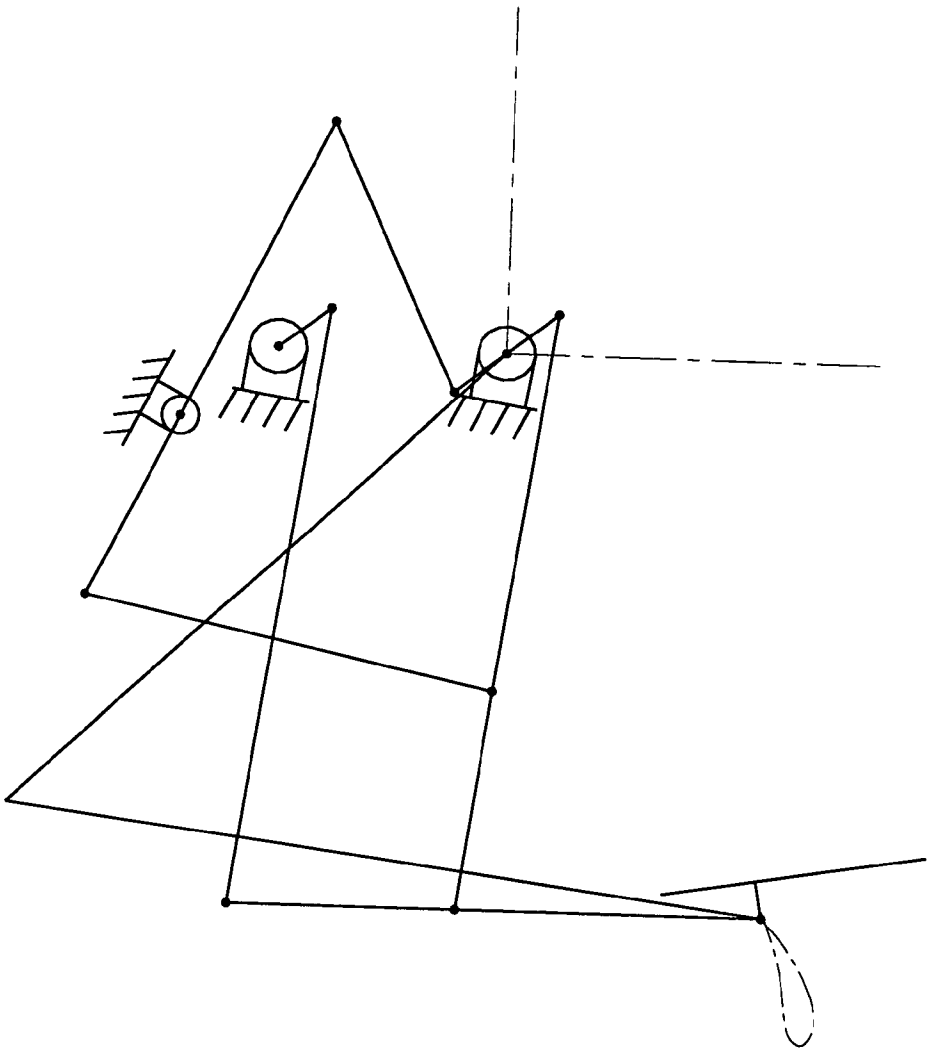
FIG. 17 is a skeleton view of the mechanism of FIG. 16 with a length of a lever arm and a pivot ratio of the lever arm adjusted relative to FIG. 16.
Figure 18:
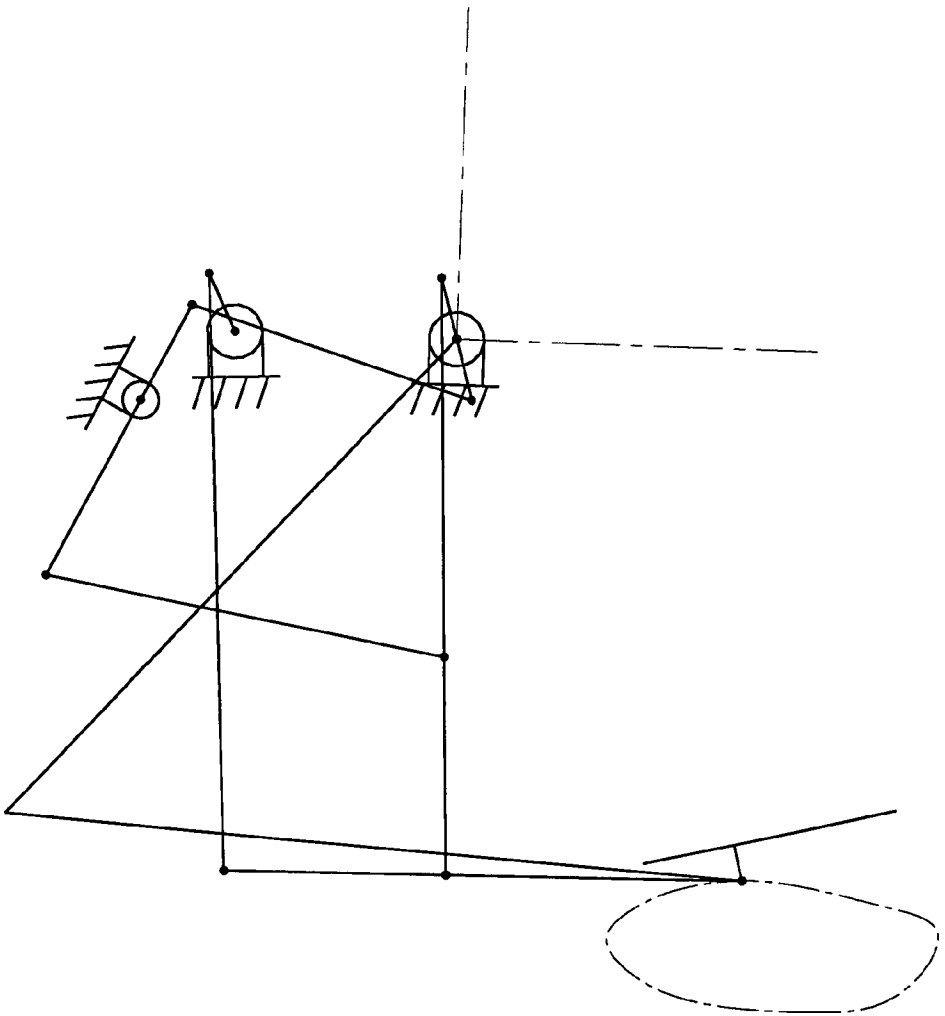
FIG. 18 is a skeleton view of the mechanism of FIG. 16 with a length of the lever arm adjusted relative to FIG. 16.
Figure 19:
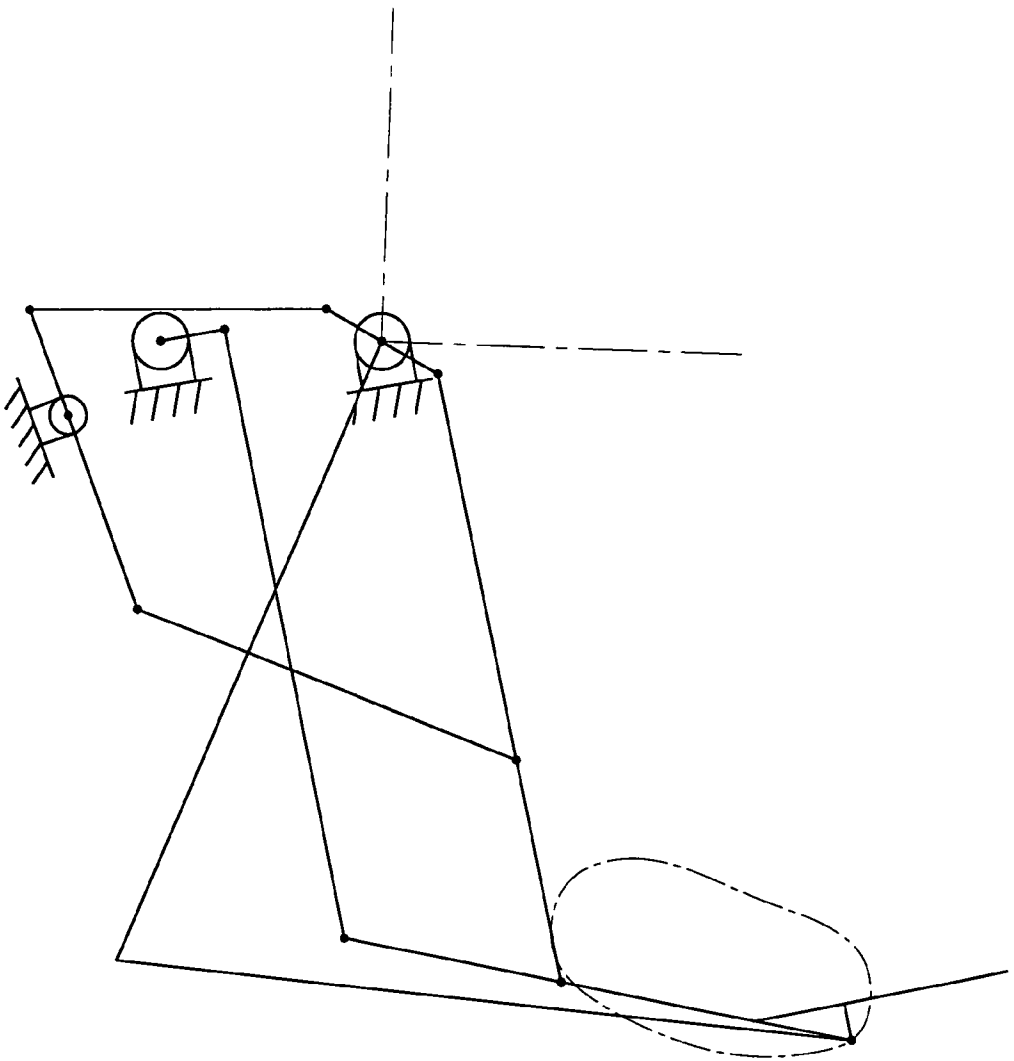
FIGS. 19, 20 and 21 are skeleton views of the mechanism of FIG. 18 with a relative angular orientation of the cranks adjusted relative to FIG. 18.
Figure 20:
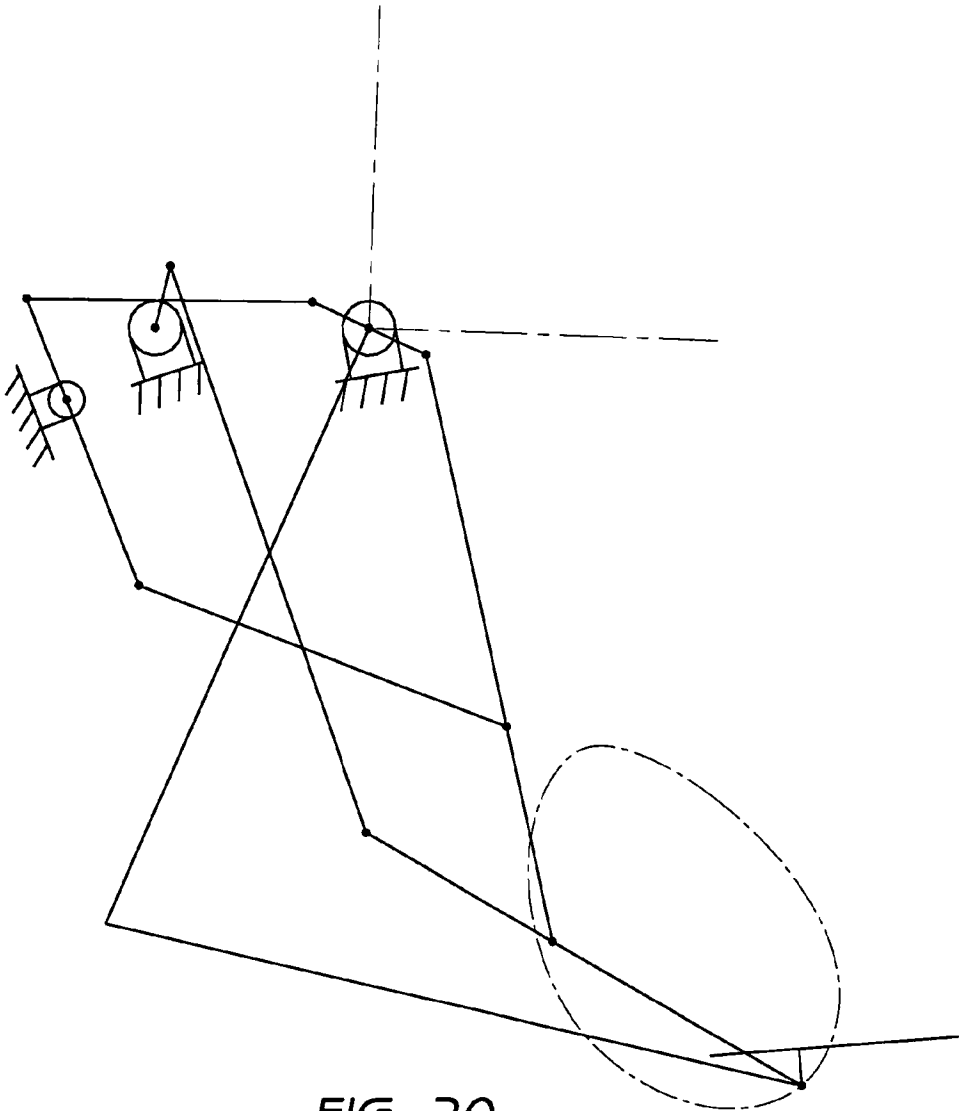
Figure 21:
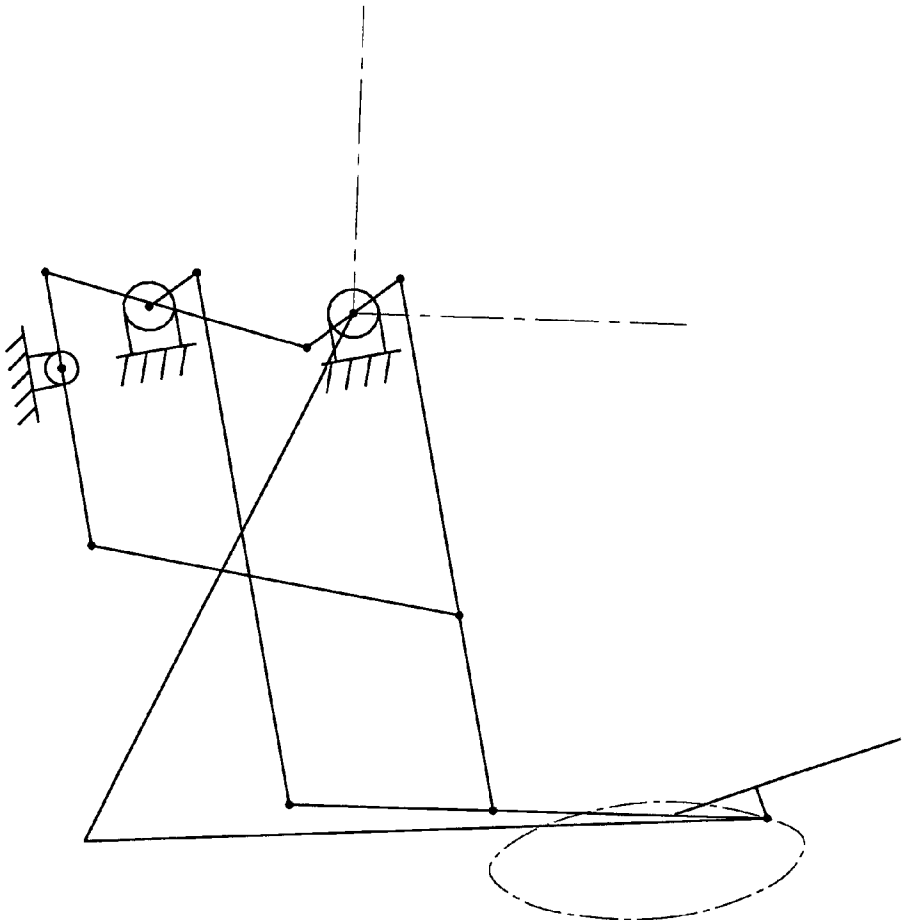
Figure 22:
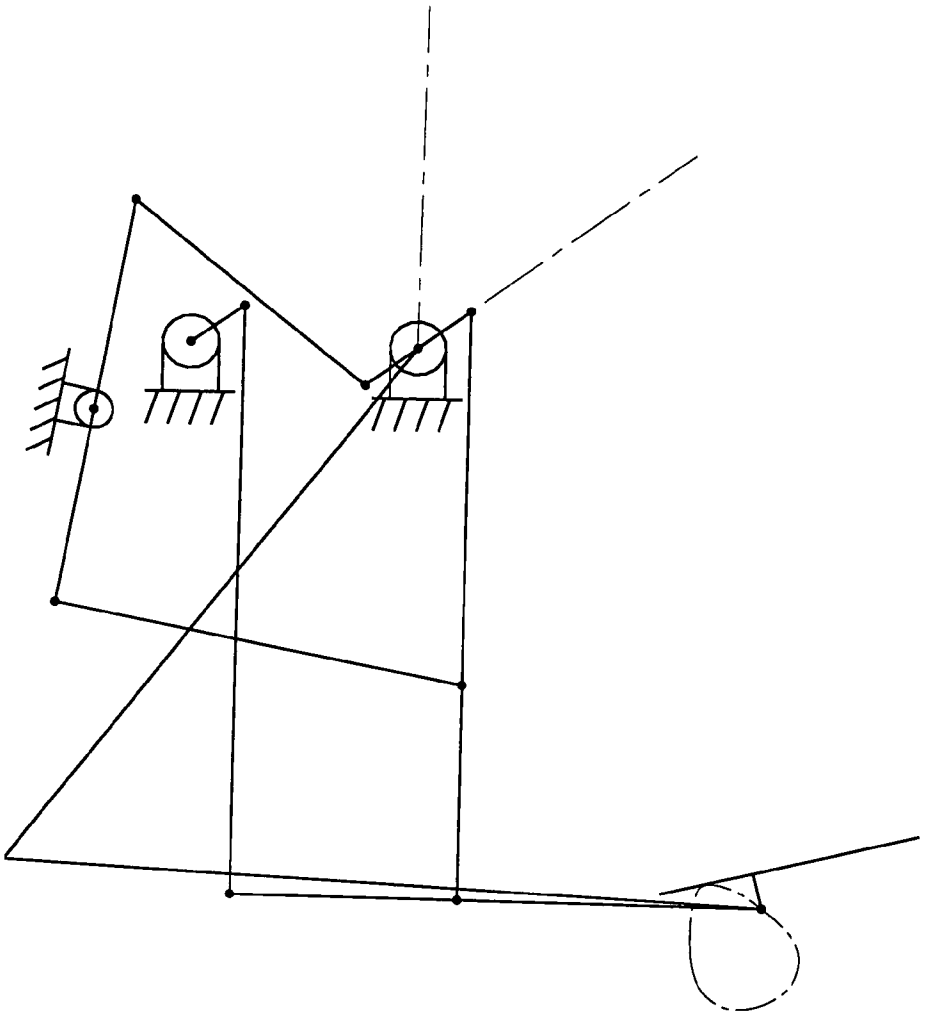
FIGS. 22 and 23 are skeleton views of the mechanism of FIG. 16 with a pivot ratio of the lever arm adjusted and a relative angular orientation of the cranks adjusted relative to FIG. 16.
Figure 23:
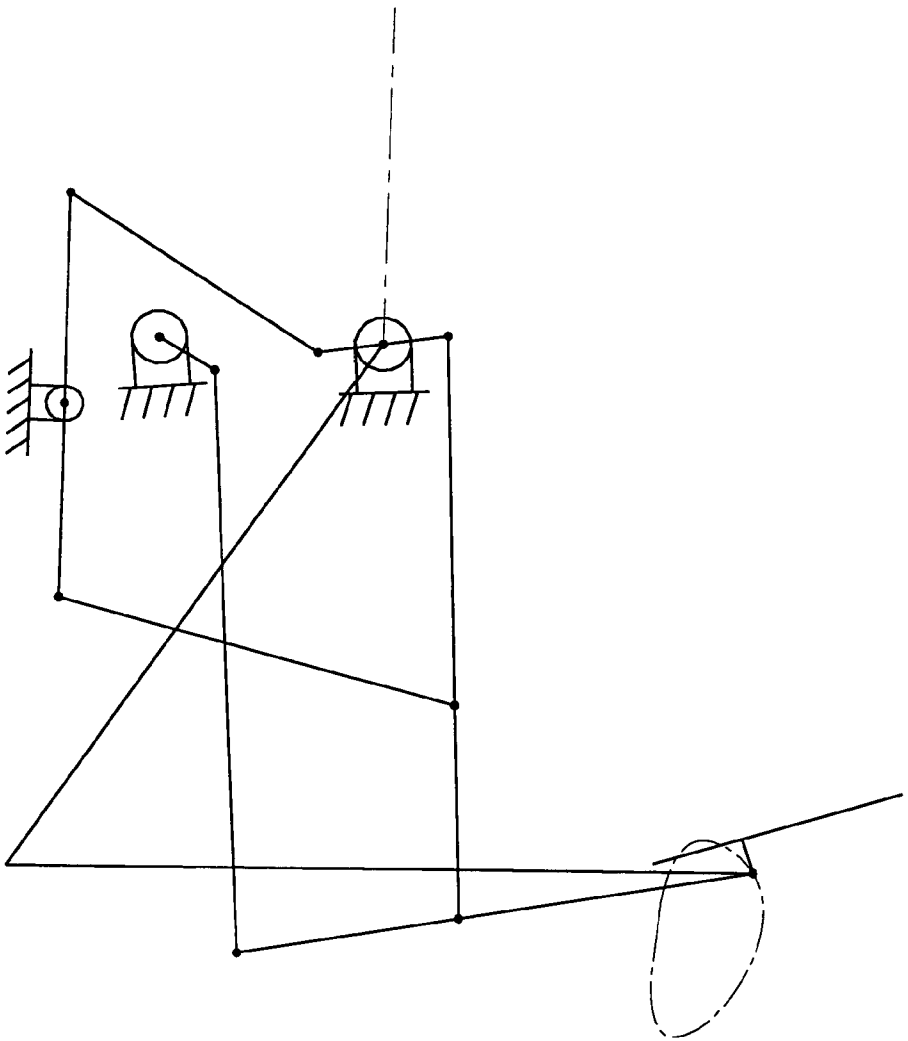
Figure 24:
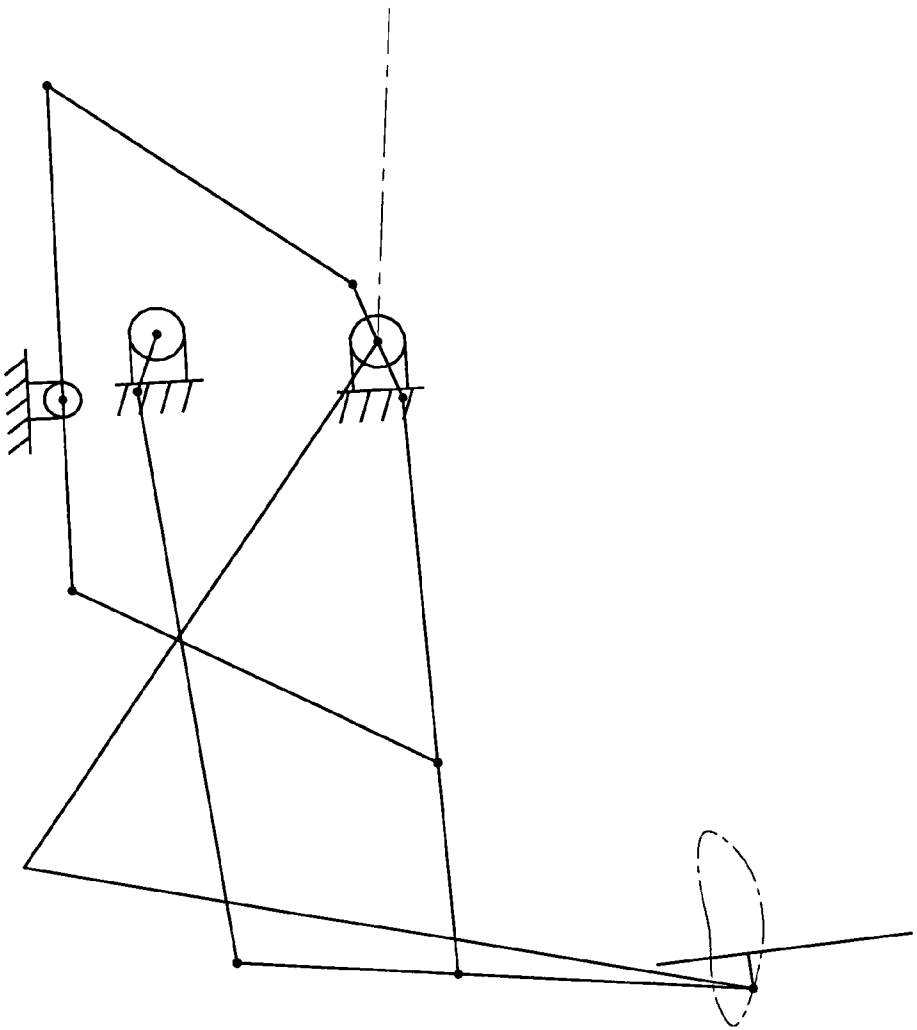
FIG. 24 is a skeleton view of the mechanism of FIG. 17 with a relative angular orientation of the cranks adjusted relative to FIG. 17.
Figure 25:
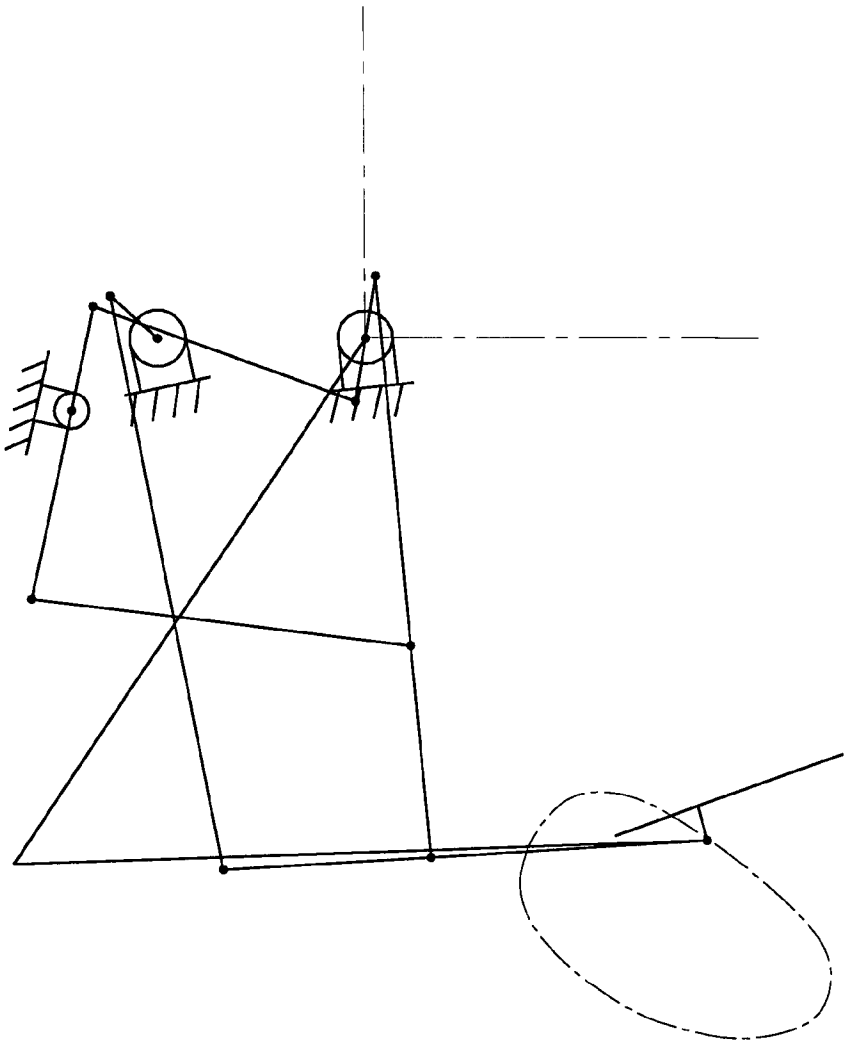
FIG. 25 is a skeleton view of the mechanism of FIG. 18 with a relative angular orientation of the cranks adjusted relative to FIG. 18.
Figure 26:
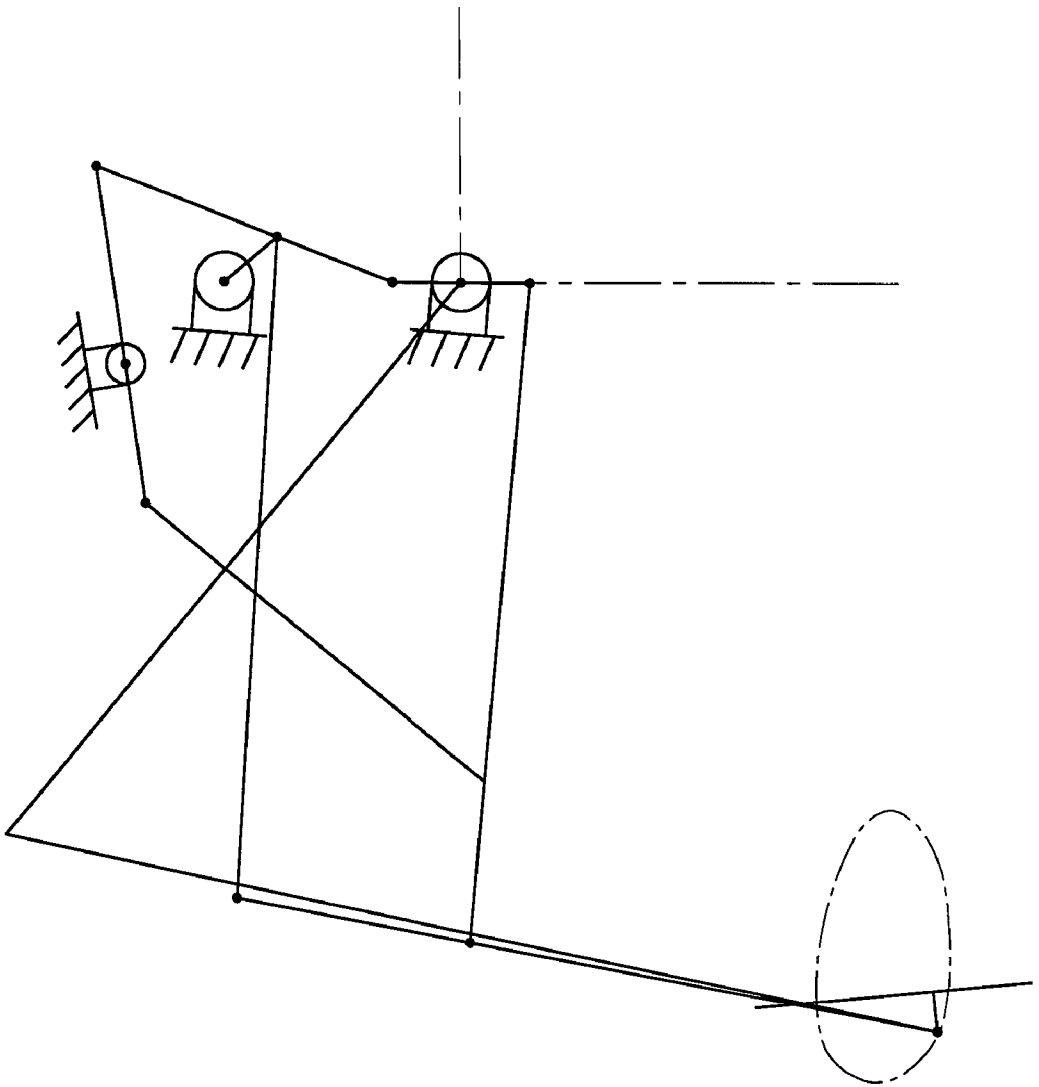
FIG. 26 is a skeleton view of the mechanism of FIG. 18 with a relative angular orientation of the cranks adjusted relative to FIG. 18 and with a pivot ratio of the lever arm adjusted relative to FIG. 18.

FIG. 16 is a skeleton view of the linkage 500. The linkage 500 is used on one side of an exercise machine arranged and configured in accordance with certain features, aspects and advantages of the present invention. The illustrated linkage 500 comprises a first crank 510 and a second crank 520. A first end 512 of the first crank 510 is pivotally mounted at a first pivot location 514. A first end 522 of the second crank 520 is pivotally mounted at a second pivot location 524. While described as pivots, the first and second pivot locations 514, 524 actually define rotational axes. Also, in the illustrated configuration, the first and second pivot locations 514, 524 are mounted at generally the same relative elevation although, in some configurations, the elevation of the first and second pivot locations 514, 524 can vary from each other and from the ground upon which the exercise machine typically rests.

A bell crank mechanism 528 can be connected to one of the first and second cranks 510, 520. The illustrated bell crank mechanism 528 preferably comprises a bell crank 530 having a first end 532 that is coupled for rotation with the first crank 510. The bell crank 530, while positioned at about 180 degrees from the first crank 510 in the illustrated configuration, can have any desired orientation relative to the first crank 510. In some configurations, for instance, the bell crank 530 can be 90 degrees out of phase from the first crank 510. Preferably, however, the bell crank 530 and the first crank 510 are coupled together or integrally formed such that the bell crank 530 rotates about the first pivot location 514 as the first crank 510 rotates about the first pivot location 514.

A second end 534 of the illustrated bell crank 530 can be pivotally connected to a first end 538 of a connecting rod 540. The connecting rod 540 has a second end 542 that is connected to a first end 548 of an oscillating lever arm 550. The oscillating lever arm 550 has a second end 552 that is coupled to a first end 558 of a drag link 560, which can also be termed a push rod.

Between the first end 548 of the lever arm 550 and the second end 552 of the lever arm 550 is a lever pivot location 554. Thus, the illustrated lever arm 550 comprises a first length 556 and a second length 557 that are respectively defined between the first end 548 of the lever arm 550 and the lever pivot location 554 and between the second end 552 of the lever arm 550 and the lever pivot location 554. Advantageously, the location of the lever pivot location 554 along the lever arm 550 can be adjusted in most configurations such that the ratio of the first length 556 and the second length 557 can be adjusted. In the illustrated configuration, adjusting the ratio such that the first length becomes smaller and the second length becomes larger results in the foot trace becoming more generally horizontal (see, e.g., FIGS. 16 and 21) while adjusting the ratio such that the first length becomes larger and the second length becomes smaller results in the foot trace becoming more generally vertical (see, e.g., FIGS. 17 and 24).

A first connecting beam 570 has a first end 572 that is connected to a second end 574 of the first crank 510 and extends generally downwardly therefrom. Similarly, a second connecting beam 580 has a first end 582 that is connected to a second end 584 of the second crank 520 and extends downwardly therefrom. A second end 576 of the first connecting beam 570 and a second end 586 of the second connecting beam 580 are pivotally mounted to a foot beam 590 respectively at a first pivot axis 578 and a second pivot axis 588.

A foot pad 592 is pivotally mounted to a rearward portion of the foot beam 590 at a foot pad pivot location 594 in the illustrated arrangement. In some configurations, the foot pad 592 is rigidly fixed to the foot beam 590; however, the illustrated pivotal configuration allows the user to experience a more natural movement. An arm lower link 700 and a leg lower link 710 can be used to force the pivotal movement and, in some configurations, to drive a pivotally mounted arm member.

In the illustrated configuration, a first end 702 of the arm lower link 700 is pivotally mounted at the first pivot location 514. In other configurations, the first end 702 of the arm lower link 700 can be mounted in other positions. For instance, the first end 702 of the arm lower link 700 can be pivotally mounted in a location that is lower than and rearward of the first pivot location 514. A second end 704 of the arm lower link 700 is pivotally mounted to the leg lower link 710 at a first end 712. A second end 714 of the leg lower link 710 is connected to the foot beam 590. In one preferred configuration, the second end 714 of the leg lower link 710 is pivotally coupled to a second end 716 of the foot beam 590. In other configurations, the second end 714 can be connected to the foot pad 592 or to another portion of the connection between the foot pad 592 and the foot beam 590. More preferably, the second end 714 is rigidly fixed to the foot pad 592 such that the foot lower link 710 can be used to drive the pivotal movement of the foot pad 592. In some configurations, the arm and leg lower links 700, 710 can be omitted.

The bell crank mechanism, which in the illustrated configuration comprises the bell crank 530, the connecting rod 540, the oscillating lever arm 550 and the drag link 560, forces a linear movement at the foot pad pivot location 594 and ultimately at the foot pad 592. Without the bell crank mechanism, the foot pad pivot location 594 and the foot pad 592 would circulate in a circular path. With the bell crank mechanism, the motion path can be forced into an elliptical shape, as desired. Thus, the bell crank takes the rotary motion of the crank 510, in the illustrated embodiment, and creates an oscillating motion at the oscillating lever arm 550.

A second end 562 of the illustrated push rod 560 is pivotally connected to a portion of the first connecting beam 570. The connection to the first connecting beam 570 provides a linear bias to the generally circular motion. In some configurations, the second end 562 of the push rod 560 can be coupled to another component of the mechanism and still result in the desired biasing. For instance, the second end 562 can be connected to any one of the following components at substantially any location along the length of the component: the second connecting beam 580, the foot beam 590, the arm lower link 700 or the leg lower link 710.

With reference now to FIGS. 16-26, the mechanism is constructed to allow the machine to alter the generated motion. As illustrated, there are multiple ways of changing motions. In one technique, the relative phase angle between the two cranks 10, 20 can be varied (see, e.g., compare FIGS. 22 and 23 or FIGS. 18, 19 and 20). In another technique, the ratio between the first length 56 and the second length 57 can be varied and/or the length of the lever arm can be changed (see, e.g., FIGS. 16 and 17). In yet another technique, a combination of the phase angle, the lever arm length and the ratio can be changed (see, e.g., FIGS. 16-26). The phase angles and the ratios can be varied in any suitable manner.

As illustrated, when the phase angle is increased (i.e., the second crank 20 is positioned counterclockwise ahead of the first crank 10) from zero, the motion transforms from generally horizontal to more vertical. For example, when the two cranks are generally at the same rotational angle, the motion is a generally horizontal ellipse but when the two cranks are positioned with the second crank 20 about 120 degrees ahead of the first crank 10 in a counterclockwise direction, the motion becomes more vertical.

Also, as illustrated, when the ratio is varied, the motion also changes. For instance, as the ratio is changed by increasing the first length 56, the motion become more vertical while the motion becomes more horizontal as the ratio is changed by decreasing the first length.

By combining the adjustments of both the phase angle and the ratios, any desired motion can be obtained. As illustrated, a first desired motion can be a generally horizontal elliptical motion and a second desired motion can be a generally vertical stepper motion. Thus, by varying the phase angle and the ratio, the movement can be changed from the first desired motion to the second desired motion.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An exercise machine comprising a generally stationary frame assembly, an operating linkage supported by said frame assembly, said operating linkage connected to a foot support, said foot support adapted to receive a user's foot, said operating linkage comprising a first crank and a second crank, said first crank being rotatable about a first axis and said second crank being rotatable about a second axis, a bell crank assembly comprising a bell crank that is rotatable with said first crank and a lever arm connected to said bell crank such that rotation of said bell crank causes oscillation of said lever arm, said lever arm being connected to said foot support, a first connecting beam connected to said first crank and a second connecting beam connected to said second crank, said first and second connecting beams also connected to said foot support such that said first and second connecting beams generate a generally circular movement at said foot support and such that said lever arm generates a generally linear movement at said foot support.

2. The machine of claim 1 further comprising a drag link that connects said lever arm to said foot support.

3. The machine of claim 1 further comprising a connecting rod that connects that lever arm to said bell crank.

4. The machine of claim 1, wherein said lever arm comprises a first end, a second end and a pivot position defined between said first end and said second end.

5. The machine of claim 4, wherein said pivot position is adjustable along said lever arm between said first end and said second end.

6. The machine of claim 1, wherein said lever arm comprises an adjustable length.

7. The machine of claim 1, wherein said first crank comprises a first angular orientation and said second crank comprises a second angular orientation, at least one of said first and second angular orientations being adjustable relative to said other of said first and second angular orientations.

8. The machine of claim 1, wherein said first crank comprise a first angular orientation and said second crank comprises a second angular orientation and said first and second angular orientations are generally said same.

9. The machine of claim 1, wherein said lever arm is adjustable in length.

10. The machine of claim 1 further comprising means for adjusting a foot trace generated by movement of said foot support.

11. The machine of claim 10, wherein said means comprises adjusting a relative angular orientation of said first crank and said second crank.

12. The machine of claim 10, wherein said means comprises adjusting a lever arm ratio.

13. The machine of claim 10, wherein said means comprises adjusting a length of said lever arm.

14. An exercise machine comprising a generally stationary frame assembly, an operating linkage supported by said frame assembly, said operating linkage comprising a first crank, said first crank having a first end connected to a first pivot axis and a second end connected to a first end of a first connecting beam, said operating linkage also comprising a second crank, said second crank having a first end connected to a second pivot axis and a second end connected to a first end of a second connecting beam, a foot beam connected to a second end of said first connecting beam and a second end of said second connecting beam, a first end of a bell crank rotatable with said first crank, a foot pad being supported by said foot beam, a second end of said bell crank being connected to a first end of a lever arm, a lever arm pivot being positioned between said first end of said lever arm and a second end of said lever arm, said second end of said lever arm connected to at least one component selected from said group consisting of said first connecting beam, said second connecting beam and said foot beam.

15. The machine of claim 14, wherein said bell crank rotates about said first pivot axis.

16. The machine of claim 14, wherein said lever arm pivot is movable along said lever arm.

17. The machine of claim 14, wherein said lever arm has an adjustable length.

18. The machine of claim 14, wherein a relative angular orientation between said first and second cranks is adapted to be adjusted by a user.

19. The machine of claim 14 further comprising means for adjusting a trace of movement generated at said foot pad.

20. machine of claim 19, wherein said means for adjusting alters said trace between at least a generally vertical trace and a generally horizontal trace.

* * * * *